US012753556B2

(12) United States Patent
Miyazaki et al.

(10) Patent No.: US 12,753,556 B2
(45) Date of Patent: Oct. 6, 2026

(54) PRESS-IN REINFORCEMENT STEEL PLATE UNDERWATER SWELL PREVENTION STRUCTURE AND STEEL PLATE PRESS-IN METHOD

(71) Applicant: ORIENTAL SHIRAISHI CORPORATION, Tokyo (JP)

(72) Inventors: Masaya Miyazaki, Tokyo (JP); Keisuke Iwasawa, Tokyo (JP); Mitsuru Harada, Tokyo (JP)

(73) Assignee: ORIENTAL SHIRAISHI CORPORATION, Tokyo (JP)

( * ) Notice: Subject to any disclaimer, the term of this patent is extended or adjusted under 35 U.S.C. 154(b) by 60 days.

(21) Appl. No.: 19/035,530

(22) Filed: Jan. 23, 2025

(65) Prior Publication Data

US 2025/0250752 A1 Aug. 7, 2025

(30) Foreign Application Priority Data

Feb. 1, 2024 (JP) ..... 2024-014073

(51) Int. Cl.
*E01D 22/00* (2006.01)
*E02D 31/00* (2006.01)

(52) U.S. Cl.
CPC ..... *E01D 22/00* (2013.01); *E02D 31/00* (2013.01); *E02D 2250/0061* (2013.01)

(58) Field of Classification Search
CPC .. E01D 22/00; E02D 5/60; E02D 5/64; E02D 5/226
See application file for complete search history.

(56) References Cited

U.S. PATENT DOCUMENTS 1,971,615 A * 8/1934 Marter ..... E02D 5/60 405/281
2,308,793 A * 1/1943 Upton ..... E02D 5/60 249/48
3,397,260 A * 8/1968 Lamberton ..... E04G 21/0472 249/90
3,890,795 A * 6/1975 Maurer ..... E02D 5/60 52/170
4,993,876 A * 2/1991 Snow ..... E02B 17/0034 52/834

(Continued)

FOREIGN PATENT DOCUMENTS

JP 2012167474 A 9/2012
JP 6189597 B2 8/2017

(Continued)

*Primary Examiner* — Benjamin F Fiorello
(74) *Attorney, Agent, or Firm* — Holtz, Holtz & Volek PC

(57) ABSTRACT

A press-in reinforcement steel plate underwater swell prevention structure that prevents, in filling with a filler, swell of a press-in reinforcement steel plate pressed-in for reinforcement around an existing columnar structure part of which is built in water, includes: a pair of swell prevention members having a Z-shaped cross section and mounted to an upper part of the existing columnar structure above a water level at time of construction, a slit being formed between the swell prevention members; and a plurality of stiffeners having a T-shaped cross section and mounted to an inner surface of the press-in reinforcement steel plate, at least one of the stiffeners being inserted in the slit.

2 Claims, 20 Drawing Sheets

(56) References Cited

U.S. PATENT DOCUMENTS

| | | | | |
|---|---|---|---|---|
| 5,226,751 | A * | 7/1993 | Doleshal | E02D 5/60 405/211.1 |
| 5,573,354 | A * | 11/1996 | Koch | E02D 5/60 405/216 |
| 8,628,275 | B1 * | 1/2014 | Trader | E02D 5/64 405/211 |
| 9,206,614 | B2 * | 12/2015 | Richardson | E04B 2/8641 |
| 10,870,999 | B1 * | 12/2020 | Oliphant | E04G 23/0225 |
| 11,674,322 | B2 * | 6/2023 | Richardson | E04G 17/001 52/742.14 |
| 2002/0094239 | A1 * | 7/2002 | Bradley | E02B 17/0026 52/514 |

FOREIGN PATENT DOCUMENTS

| | | | |
|---|---|---|---|
| JP | 6855151 | B1 | 4/2021 |
| JP | 2021188286 | A | 12/2021 |

* cited by examiner

PRESS-IN REINFORCEMENT STEEL PLATE UNDERWATER SWELL PREVENTION STRUCTURE AND STEEL PLATE PRESS-IN METHOD

BACKGROUND

Technical Field

The present invention relates to a press-in reinforcement steel plate underwater swell prevention structure and a steel plate press-in method.

Related Art

A steel plate press-in method for reinforcing a columnar structure is known in which a reinforcement steel plate is pressed-in while the columnar structure bearing the reaction force. For example, JP 2012-167474 A discloses a press-in device fixed to a columnar structure to press-in a cylindrical steel plate using a telescopic jack to reinforce the columnar structure (see, for example, paragraphs [0026] to [0030] of the specification and FIGS. 8 to 14 of JP 2012-167474 A).

However, in a case where the height of the columnar structure from the foundation is large and the height of the portion to be reinforced by the reinforcement steel plate is increased, the reinforcement steel plate, in some cases, swells or deviates due to the internal pressure of a filler such as mortar that fills the gap between the steel plate and the columnar structure.

JP 6855151 B2 discloses a steel plate press-in method in which a rectangular reinforcement steel plate to which spacers and rollers are mounted is pressed-in around a columnar structure on which a partial pressure such as a partial earth pressure or a partial water pressure acts (see, for example, paragraphs [0033] to [0057] of the specification and FIGS. 7 to 10 of JP 6855151 B2).

In the steel plate press-in method described in JP 6855151 B2, the spacers and the rollers can bear the partial pressure since it is assumed as a compressive force applied from the outside as an external force, but it is not possible to prevent swell of the pressed-in steel plate from the inside to the outside.

JP 6189597 B2 discloses a reinforcement structure of an existing columnar structure. In this structure, flat plates having a Z-shaped cross section are mounted near the lower end of an inner surface of a reinforcement steel plate to be pressed-in to form a slit. A retaining steel member made of an H-shaped steel beam is inserted into the slit to fill a gap between the existing columnar structure and the reinforcement steel plate to prevent a lower end portion of the reinforcement steel plate from swelling away from the existing columnar structure (see, for example, claims 1 and 2, paragraphs [0032] to [0047] of the specification, and FIGS. 1 to 8 of JP 6189597 B2).

Contrary to the reinforcement structure of the columnar structure described in JP 6189597 B2, it is conceivable that the slit is formed on the existing columnar structure and a buckling preventing member that stiffens the reinforcement steel plate so as not to be buckled at the time of press-in is inserted, so that the buckling preventing member has both a function of a swell prevention member and a function of a guide member that guides the reinforcement steel plate in the vertical direction at the time of press-in.

However, when the swell prevention member is used as a guide member, high precision is required for marking and installation. In particular, when the swell prevention member is located in water, even a diver has difficulty in ensuring precision for the swell prevention member in underwater construction. In addition, to fix a steel member to an existing columnar structure, chemical anchor (registered trademark) is typically used, but it is difficult to use chemical anchor in water. Thus, it is difficult to mount the swell prevention member to the existing columnar structure in water.

SUMMARY

The present invention has been made in view of the foregoing, and it is an object of the present invention to provide a press-in reinforcement steel plate underwater swell prevention structure and a steel plate press-in method that are less likely to cause swell or deviation of the reinforcement steel plate due to an internal pressure of a filler even when the height of an existing columnar structure to be reinforced is large and the lower portion of the existing columnar structure is located in water.

A press-in reinforcement steel plate underwater swell prevention structure according to a first aspect of the present invention is a press-in reinforcement steel plate underwater swell prevention structure that prevents, in filling with a filler, swell of a press-in reinforcement steel plate pressed-in for reinforcement around an existing columnar structure part of which is built in water, the press-in reinforcement steel plate underwater swell prevention structure includes: a pair of swell prevention members having a Z-shaped cross section and mounted to an upper part of the existing columnar structure above a water level at time of construction, a slit being formed between the swell prevention members; a plurality of stiffeners having a T-shaped cross section and mounted to an inner surface of the press-in reinforcement steel plate, at least one of the plurality of stiffeners being inserted in the slit; and one or a plurality of supports made of assembled steel members and installed around an underwater portion of the press-in reinforcement steel plate to prevent swell of the press-in reinforcement steel plate in filling with a filler.

A steel plate press-in method according to a second aspect of the present invention is a steel plate press-in method for pressing-in a press-in reinforcement steel plate around an existing columnar structure built in water for reinforcement, the steel plate press-in method includes: a swell prevention member mounting step of mounting a pair of swell prevention members having a Z-shaped cross section to an upper part of the existing columnar structure above a water level at time of construction and forming a slit between the swell prevention members; a press-in step of pressing-in the press-in reinforcement steel plate around the existing columnar structure; and a filler filling step of filling a gap between the press-in reinforcement steel plate and the existing columnar structure with a filler, in which the press-in step includes inserting a stiffener protruding from an inner surface of the press-in reinforcement steel plate into the slit between the swell prevention members mounted in the swell prevention member mounting step and pressing-in the press-in reinforcement steel plate while being guided by the swell prevention members in a press-in direction, the steel plate press-in method further including, before the filler filling step, a support installing step of installing, around an underwater portion of the press-in reinforcement steel plate, a support that prevents swell of the press-in reinforcement steel plate in the filler filling step.

Advantageous Effects of Invention

According to the first and second aspects of the present invention, the swell prevention members are installed to an upper part of the existing columnar structure above the water level at the time of construction, and thus the swell prevention members can be precisely mounted even when the height of the existing columnar structure to be reinforced is large and the lower portion of the existing columnar structure is located in water. This configuration allows the swell prevention members to function as a guide member for guiding the reinforcement steel plate in the vertical direction at the time of press-in, and can prevent swell or deviation of the reinforcement steel plate due to the internal pressure of the filler.

Moreover, according to the first and second aspects of the present invention, in addition to installing the swell prevention members, the support is installed around the underwater portion of the press-in reinforcement steel plate. This configuration can reliably prevent swell or deviation of the reinforcement steel plate due to the internal pressure of the filler.

DETAILED DESCRIPTION

Hereinafter, an embodiment of a press-in reinforcement steel plate underwater swell prevention structure and a steel plate press-in method according to the present invention will be described in detail with reference to the drawings.

(Press-In Reinforcement Steel Plate Underwater Swell Prevention Structure)

Figure 1:
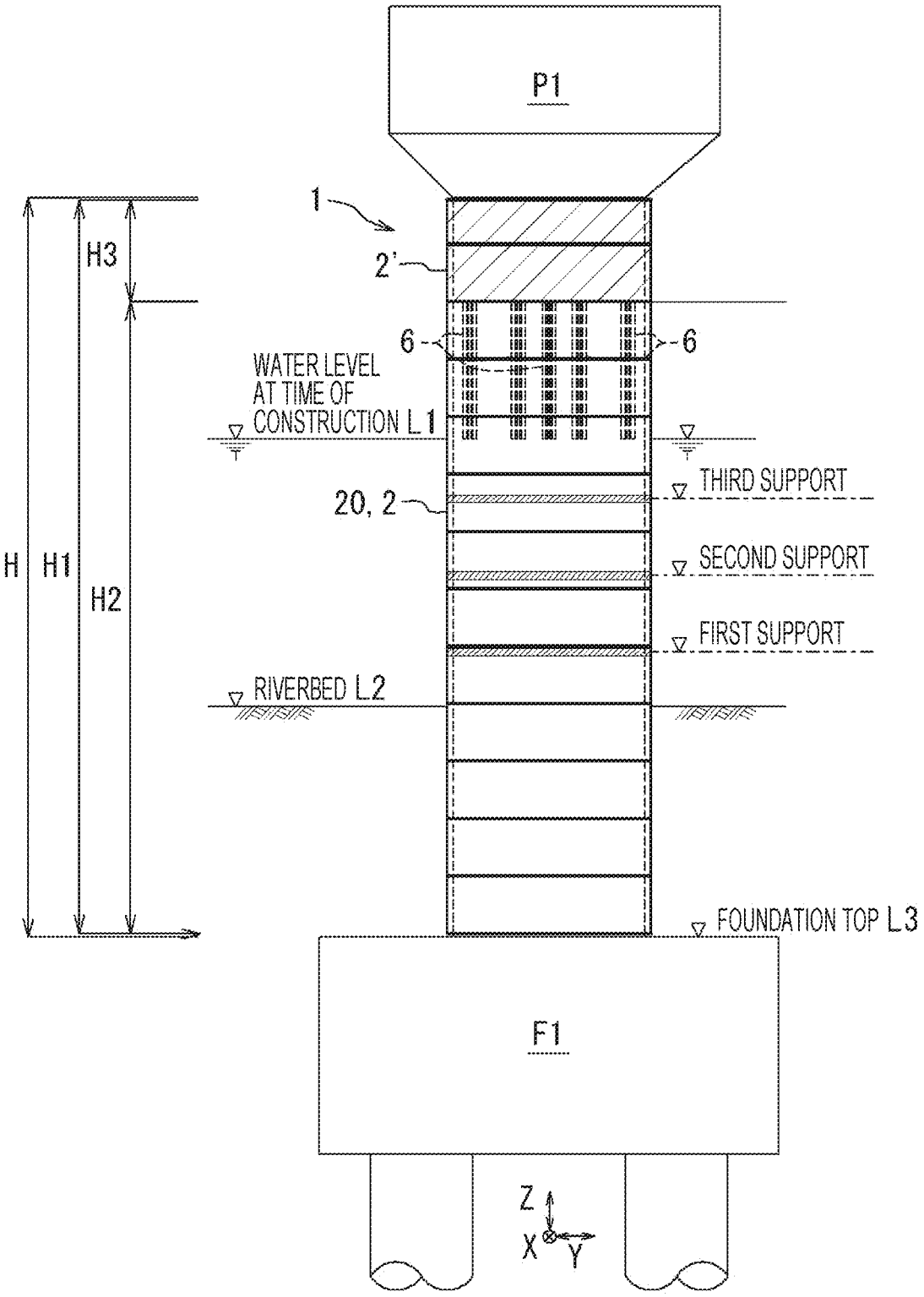
FIG. 1 is a front view of a bridge pier to which a press-in reinforcement steel plate underwater swell prevention structure according to an embodiment of the present invention is applied, viewed in a bridge axis direction.
Figure 2A:
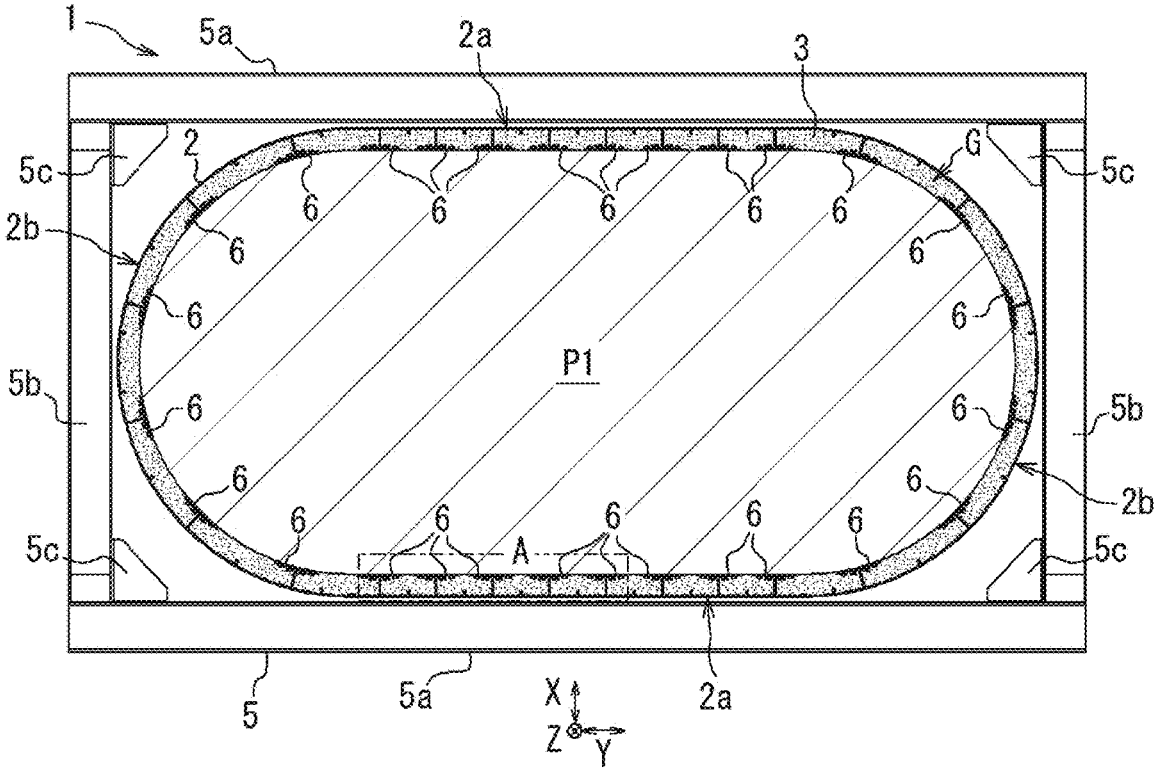
FIG. 2A is a plan view illustrating the bridge pier to which the press-in reinforcement steel plate underwater swell prevention structure is applied.
Figure 2B:
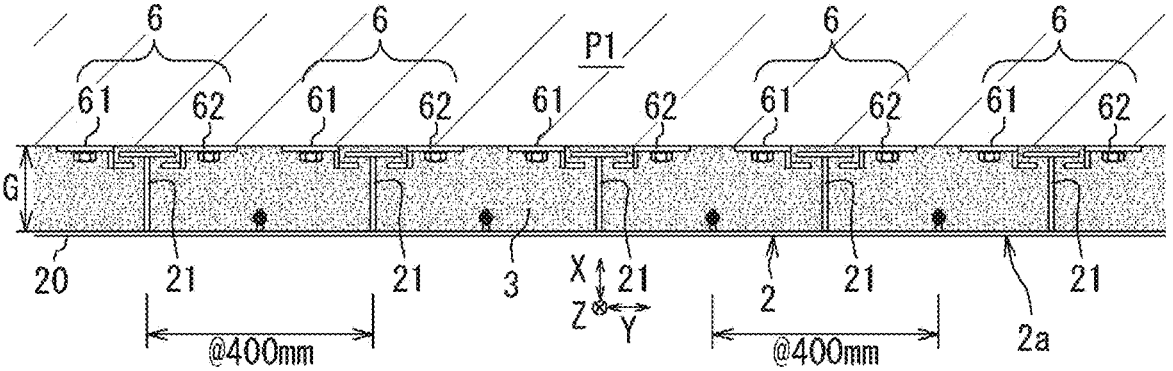
FIG. 2B is an enlarged view of portion A in FIG. 2A.

First, with reference to FIGS. 1 to 3B, a press-in reinforcement steel plate underwater swell prevention structure 1 according to an embodiment of the present invention will be described. The following describes a bridge pier P1 of an existing bridge built in a river and having an oval-shaped horizontal cross section as an example of an existing columnar structure to which the press-in reinforcement steel plate underwater swell prevention structure 1 according to the present embodiment is applied. FIG. 1 is a front view of the bridge pier P1 to which the press-in reinforcement steel plate underwater swell prevention structure 1 is applied, viewed in a bridge axis direction X. FIG. 2A is a plan view illustrating the bridge pier P1 to which the press-in reinforcement steel plate underwater swell prevention structure 1 is applied. FIG. 2B is an enlarged view of portion A of FIG. 2A.

Figure 3A:
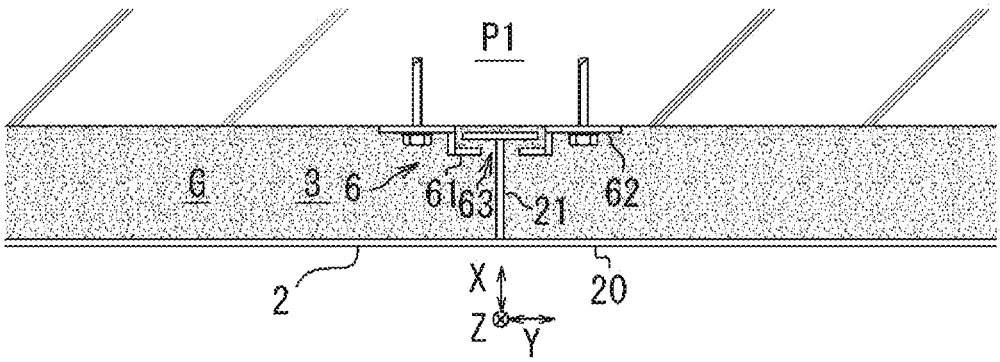
FIG. 3A is a partially enlarged plan view illustrating a swell prevention member of the press-in reinforcement steel plate underwater swell prevention structure.
Figure 3B:
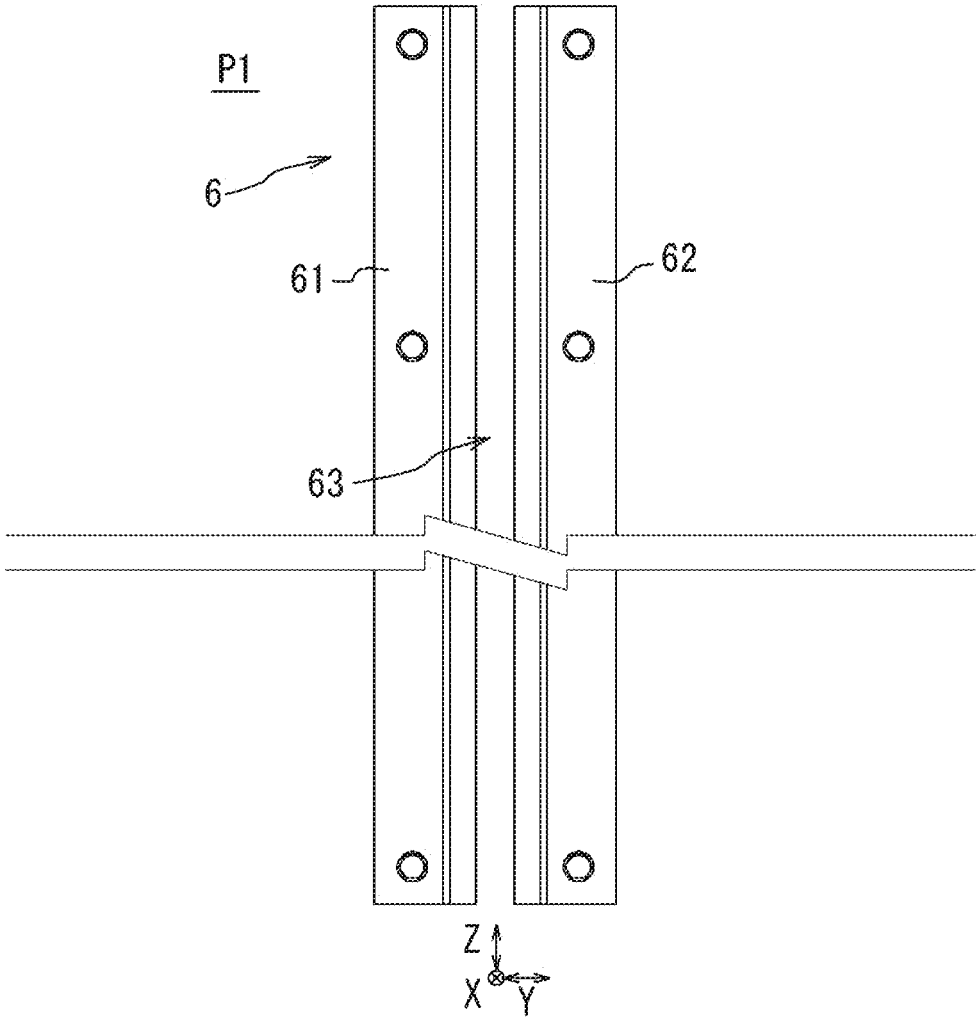
FIG. 3B is a detailed elevation view illustrating the swell prevention member.

FIG. 3A is a partially enlarged plan view illustrating a swell prevention member 6 of the press-in reinforcement steel plate underwater swell prevention structure, and FIG. 3B is a detailed elevation view illustrating the swell prevention member. Note that a reference sign X in the drawings indicates the bridge axis direction X of the bridge pier P1, a reference sign Y indicates a bridge axis perpendicular direction Y, and a reference sign Z indicates a vertical direction Z. In addition, a reference sign H in FIG. 1 represents a height H of the reinforcement range of the columnar structure to be reinforced, and H1 represents a height H1 of the reinforcement steel plate obtained by excluding a clearance from the height H of the reinforcement range. H2 represents a height H2 of press-in reinforcement steel plates 2, and H3 represents a height H3 of the post-installation part.

The press-in reinforcement steel plate underwater swell prevention structure 1 (hereinafter simply referred to as swell prevention structure 1) according to the present embodiment is a press-in reinforcement steel plate underwater swell prevention structure that prevents, in filling with a filler 3, swell of the press-in reinforcement steel plate 2 pressed-in around the bridge pier P1 for reinforcement. The bridge pier P1 is an existing columnar structure part of which is built in water (in a river).

The swell prevention structure 1 includes a press-in reinforcement steel plate 2 that is pressed-in around the bridge pier P1 to reinforce the bridge pier P1, the filler 3 with which a gap G between the press-in reinforcement steel plate 2 and the bridge pier P1 is filled, and a support 5 that prevents swell of the press-in reinforcement steel plate 2 in filling with the filler 3. The bridge pier P1 is also provided with a swell prevention member 6 that prevents the press-in reinforcement steel plate 2 from swelling away from the bridge pier P1 when the gap G between the press-in reinforcement steel plate 2 and the bridge pier P1 is filled with the filler 3.

(Press-In Reinforcement Steel Plate)

The press-in reinforcement steel plate 2 is a steel plate having a predetermined thickness (9 mm in the drawings) according to the structural design as a base and is welded and assembled on site to form a reinforcement steel plate assembly 20 having an oval-shaped horizontal cross section conforming to the cross-sectional shape of the bridge pier P1 as illustrated in FIGS. 2A, 2B, and 3A. Of course, the shape and thickness of the press-in reinforcement steel plate 2 may be appropriately set according to the cross-sectional shape and structural design of the existing columnar structure to be reinforced.

On the inner surface of the reinforcement steel plate assembly 20, stiffeners 21 having a T-shaped cross section are provided and protrude along the axial direction to stiffen the steel plate so that the steel plate bears stress such as buckling stress acting on the steel plate at the time of press-in. As illustrated in FIG. 2A, in the reinforcement steel plate assembly 20 having an oval shape, the stiffeners 21 are densely disposed at a pitch of 400 mm on a flat portion 2*a* having a high possibility of buckling, and are disposed at a pitch of 800 mm on an arcuate portion 2*b*. As illustrated in FIG. 2A, the gap G between the press-in reinforcement steel plate 2 and the bridge pier P1 is set to 150 mm in the present embodiment.

Note that a post-installation reinforcement steel plate 2' indicated by diagonal lines in FIG. 1 is a post-installation part to be installed after removal of a press-in device (PD) and a reaction force resistant steel plate (7) to be described later.

(Filler)

The filler 3 is a typical filling concrete, and the design reference strength is appropriately determined depending on the structural design. Of course, the filler 3 is not limited to concrete and may be, for example, non-shrunk mortar or any hardening material having a predetermined compressive strength for holding the press-in reinforcement steel plate 2 after a certain time has passed.

(Support)

As illustrated in FIG. 2A, the support 5 is a structure made of H-shaped steel beams (general structural hot rolled steel: SS400), which are retainers, assembled to have an oblong shape (rectangular shape), and has a function of preventing swell of the press-in reinforcement steel plate 2 at the time of filling with the filler 3. An H-shaped steel beam of H-350×350×12×19 is used for a long side portion 5*a*, and an H-shaped steel beam of H-300×300×10×15 is used for a short side portion 5*b*.

A corner piece 5*c* is attached to each corner so that the orthogonal long side portion 5*a* and short side portion 5*b* are not angularly deformed.

As illustrated in FIG. 1, in the present embodiment, the support 5 includes a first support to a third support that are installed at three locations at substantially equal intervals of the height difference between a height L2 of the riverbed, which is the ground, and a water level L1 at the time of construction. The press-in reinforcement steel plate 2 pressed-in to the ground hardly swells due to the internal pressure at the time of filling with the filler 3 and the swell prevention member 6 to be described later prevents swelling outward of the press-in reinforcement steel plate 2 above the water level L1 at the time of construction. Of course, the installation positions of the support 5, the dimensions of the steel members, and the like may be appropriately set by structural calculations according to the distance from the height L2 of the ground to the water level L1 at the time of construction, and the support 5 may be installed at one location.

A gap between the outer peripheral surface of the press-in reinforcement steel plate 2 and the support 5 is adjusted by inserting a backing member such as uniblock (registered trademark) or a wedge made of a steel member or the like (not illustrated). Of course, the support 5 may be assembled with no gap left therebetween.

(Swell Prevention Member)

As illustrated in FIGS. 3A and 3B, the swell prevention member 6 includes a pair of latching plates 61 and 62 made of a steel member having a Z-shaped cross section, and has a function of latching, with the latching plates 61 and 62, a stiffener 21 having a T-shaped horizontal cross section and joined to the press-in reinforcement steel plate 2, and a function of preventing the press-in reinforcement steel plate 2 to which the stiffener 21 is joined from swelling away from the bridge pier P1.

As illustrated in FIGS. 3A and 3B, the latching plates 61 and 62 are separated in the horizontal direction (bridge axis perpendicular direction Y) and fixed to the bridge pier P1 by chemical anchor of M16. A slit 63 is formed between the latching plate 61 and the latching plate 62, and as illustrated in FIG. 3A, the stiffener 21 is inserted into the slit 63 of the swell prevention member 6, and the flange of the stiffener 21 is latched to the latching plates 61 and 62, thereby preventing the press-in reinforcement steel plate 2 from swelling away from the bridge pier P1.

As illustrated in FIG. 1, the swell prevention member 6 is mounted above the water level L1 of the river at the time of construction of the bridge pier P1. This configuration is to prevent underwater installation of the swell prevention member 6 since marking and installation positioning require high precision. As described in the related art, when the swell prevention member 6 also has the function of the guide member that precisely guides the press-in direction of the press-in reinforcement steel plate 2 in the vertical direction at the time of press-in, the press-in is disturbed if the swell prevention member 6 is mounted in a leaned manner. Here, "above the water level L1 at the time of construction" refers to a case in which most (at least half or more in the height direction) of the swell prevention member 6 is located higher than the water level L1 at the time of construction, and the installation position of the chemical anchor is located higher than the water level L1 at the time of construction. If the installation position of the chemical anchor is higher than the water level L1 at the time of construction, the swell prevention member 6 can be easily mounted by ground work on the float or the scaffold as described later.

However, no swell prevention member 6 is mounted to the installation part (post-installation part) of the post-installation reinforcement steel plate 2' indicated by diagonal lines in FIG. 1. Installation of the steel plate and filling with the filler are performed by separate installation process after the press-in device and the reaction force resistant steel plate are removed, and thus the post-installation part does not need a function of a guide member or a function of swell prevention.

As illustrated in FIGS. 2A and 2B, in the drawings, for example, all the stiffeners 21 are latched with the swell prevention members 6, but latching some of the plurality of stiffeners 21 with the swell prevention members 6 may be sufficient. When the pressure is small at the time of filling with the filler 3, it is not necessary to provide all the guide members.

(Steel Plate Press-In Method)

Next, with reference to FIGS. 1 to 20, a steel plate press-in method according to the embodiment of the present invention will be described. The following describes a case in which the bridge pier P1 as an example of the existing columnar structure described above has an oval-shaped horizontal cross section and is built in a river and the press-in reinforcement steel plate 2 described above is pressed-in around the oval bridge pier P1 for reinforcement.

(Preparation)

Figure 4:
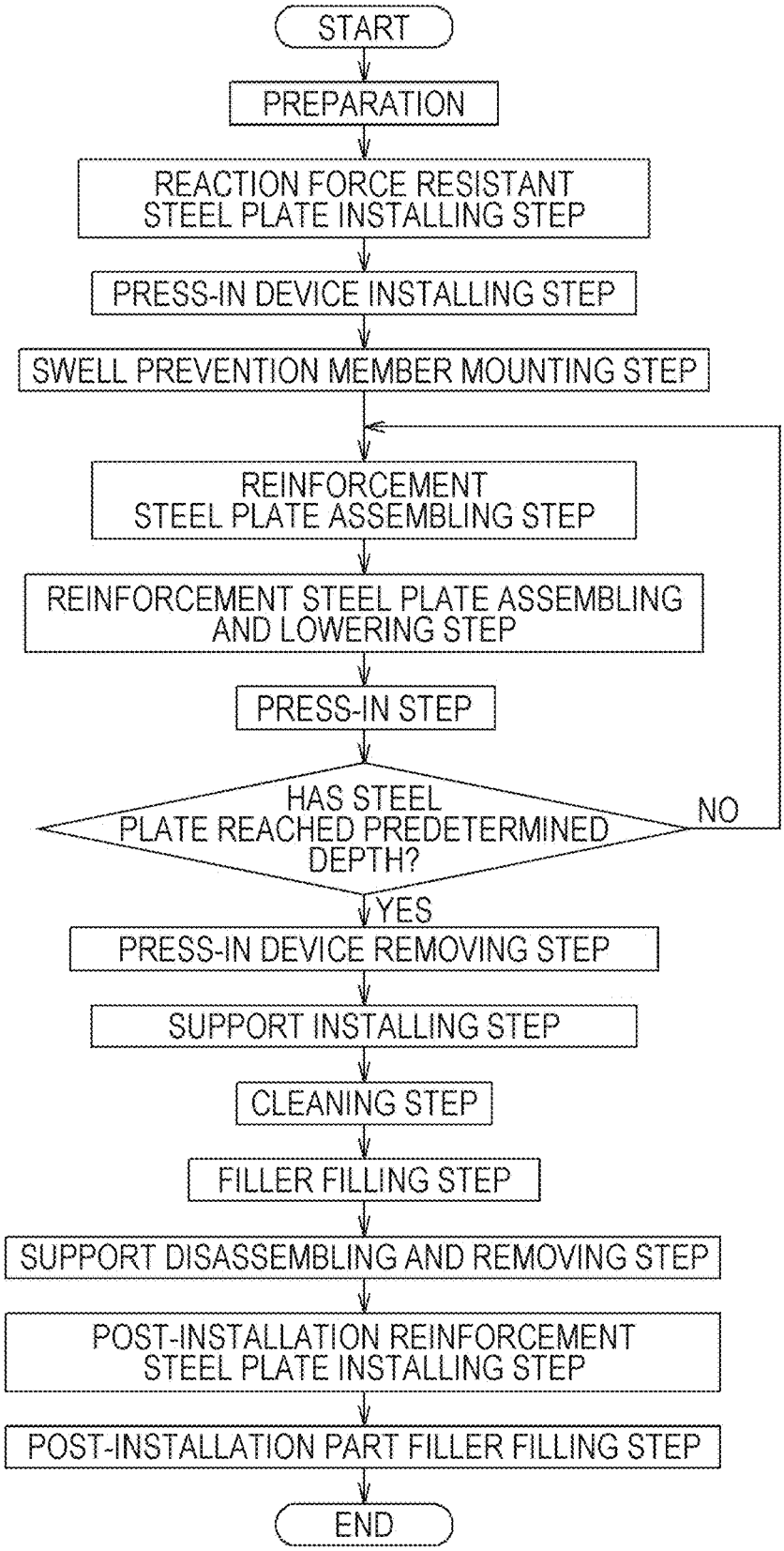
FIG. 4 is a flowchart illustrating the steps of a steel plate press-in method according to the embodiment of the present invention.
Figure 5:
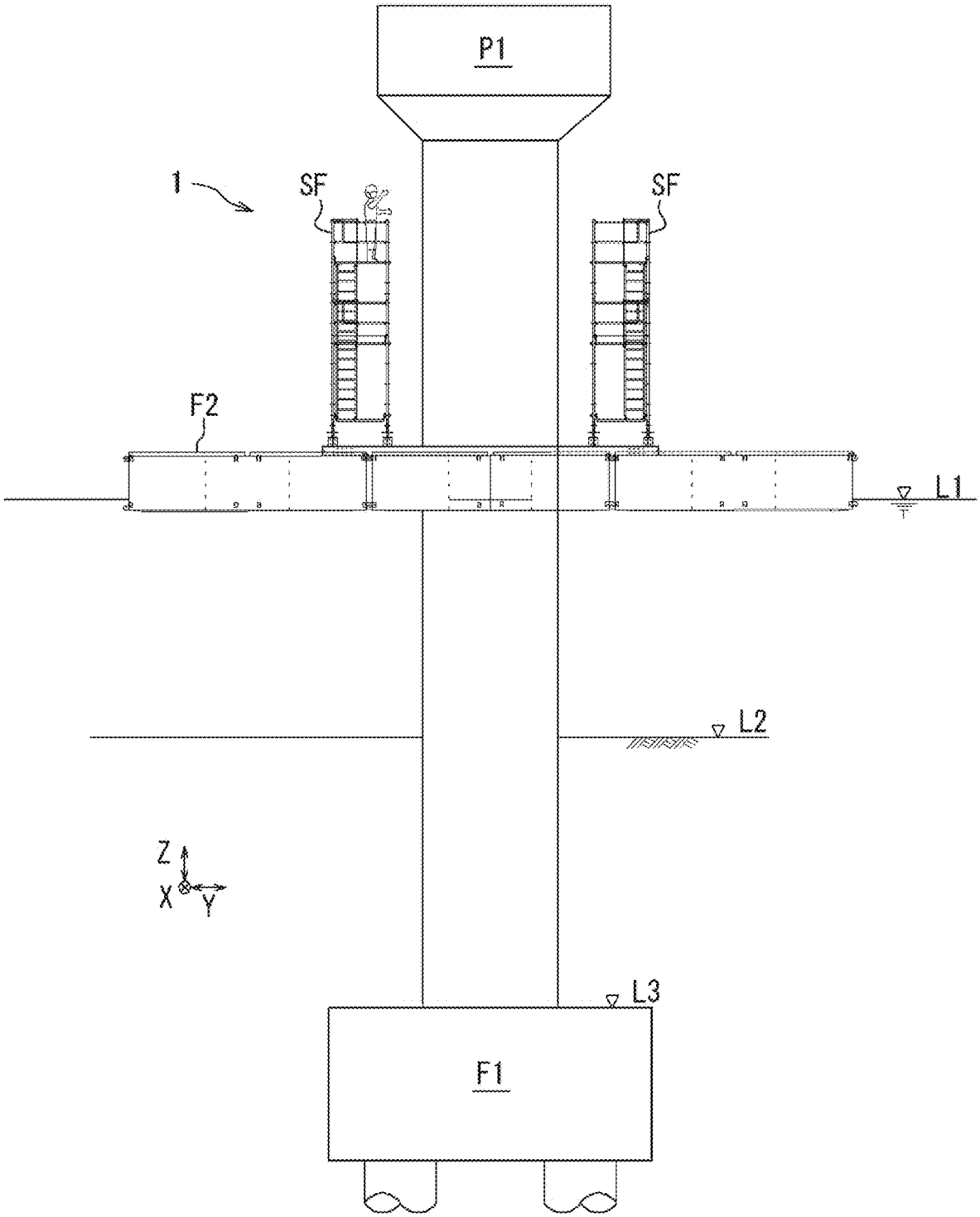
FIG. 5 is a diagram illustrating preparation for the steel plate press-in method.

First, as preparation in the steel plate press-in method according to the present embodiment, as illustrated in FIGS. 4 and 5, floats are arranged and connected to each other around the bridge pier P1 built in a river to assemble a float F2, and a wedge-type scaffold, a framework scaffold, or the like is assembled thereon to install a scaffold Sf for use in press-in and lifting to be described later. FIG. 4 is a flowchart illustrating the steps of the steel plate press-in method according to the present embodiment, and FIG. 5 is a diagram illustrating preparation for the steel plate press-in method according to the present embodiment.

(Reaction Force Resistant Steel Plate Installing Step)

Figure 6:
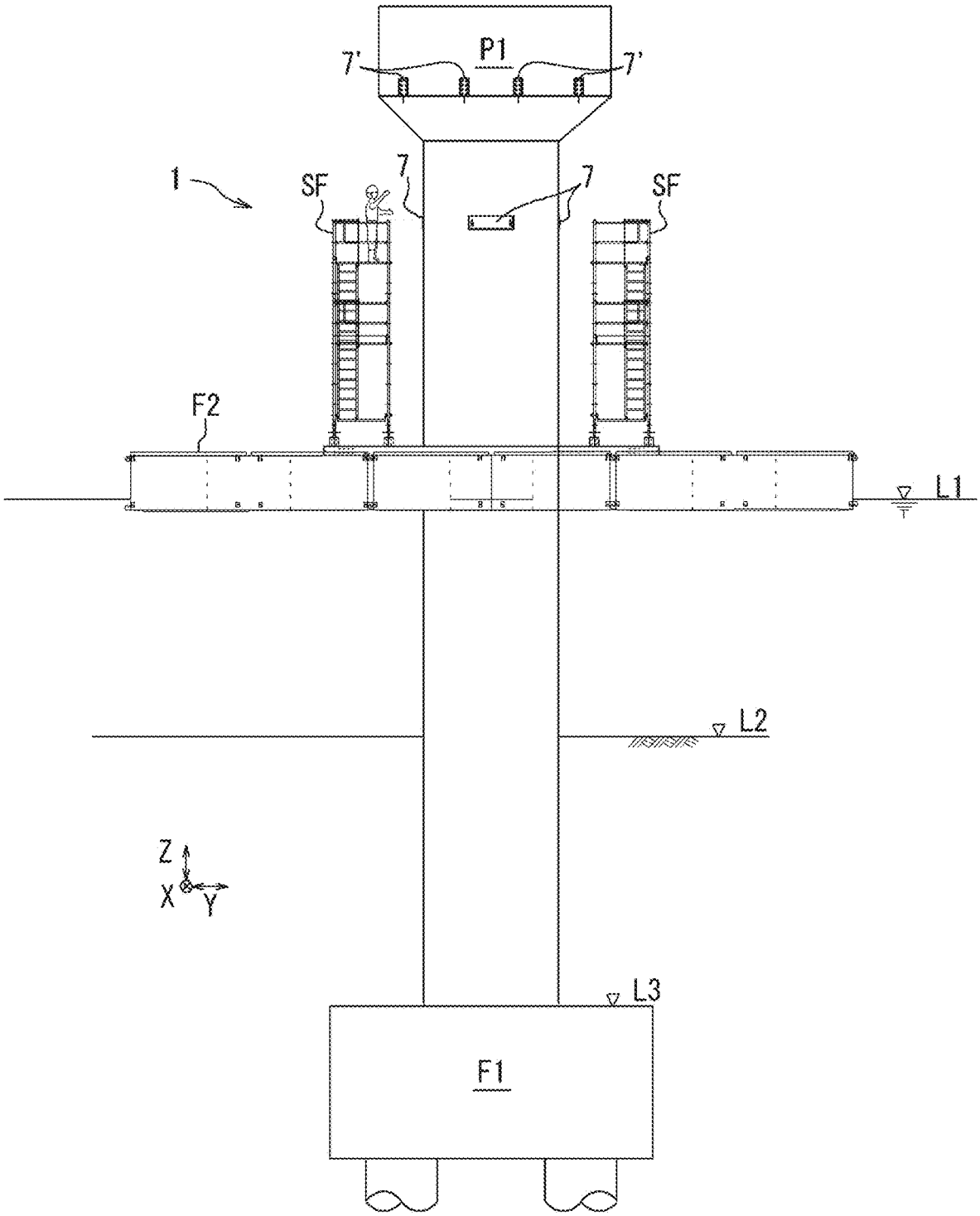
FIG. 6 is a diagram illustrating a reaction force resistant steel plate installing step of the steel plate press-in method.

Subsequently, as illustrated in FIGS. 4 and 6, in the steel plate press-in method according to the present embodiment, a reaction force resistant steel plate installing step of installing a reaction force resistant steel plate 7 for the press-in device (PD) and a reaction force resistant steel plate 7' for the manual lifting device (LD) such as a chain block or lever block (registered trademark) on the bridge pier P1 is performed. FIG. 6 is a diagram illustrating the reaction force resistant steel plate installing step of the steel plate press-in method according to the present embodiment.

Specifically, in this step, post-installation anchors are installed to an upper part of the bridge pier P1, and then the reaction force resistant steel plates 7 and 7' are fixed and installed with bolts to the post-installation anchors. Of course, the method of fixing the reaction force resistant steel plates 7 and 7' to the bridge pier P1 is not limited to the post-installation anchor, and may be appropriately determined according to the columnar structure.

(Press-In Device Installing Step)

Figure 7:
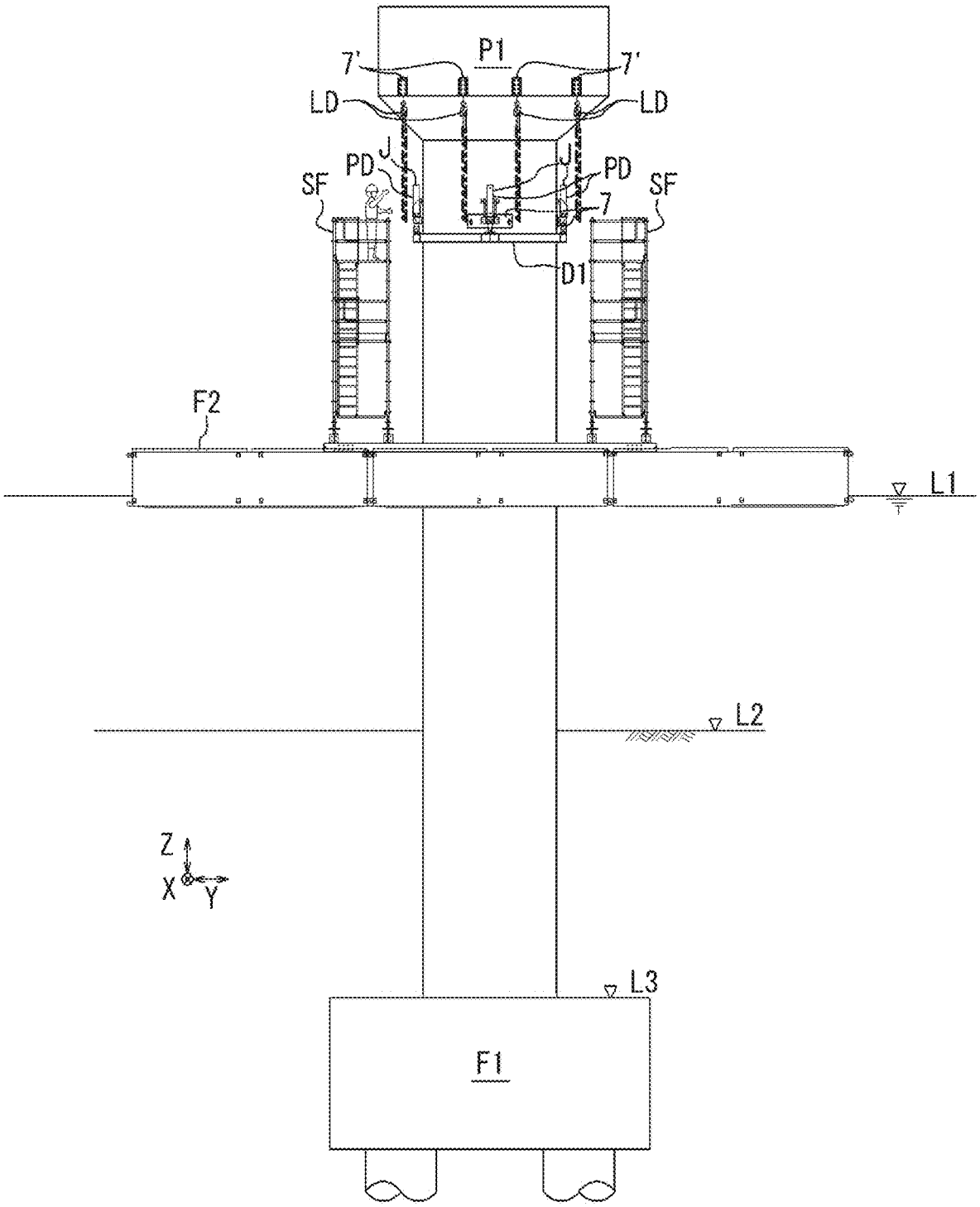
FIG. 7 is a diagram illustrating a press-in device installing step of the steel plate press-in method.

Subsequently, as illustrated in FIGS. 4 and 7, in the steel plate press-in method according to the present embodiment, a press-in device installing step is performed in which a press-in device PD is mounted and installed to the reaction force resistant steel plate 7 (7') installed in the previous step. FIG. 7 is a diagram illustrating the press-in device installing step of the steel plate press-in method according to the present embodiment.

Specifically, in this step, the press-in device PD is bolted to the reaction force resistant steel plate 7 to be supported on and fixed to the upper part of the bridge pier P1, and a manual lifting device LD is mounted to the reaction force resistant steel plate 7'. Of course, the press-in device PD may be supported on and fixed to the bridge pier P1 in any manner other than bolt joining.

The press-in device PD is a linear motion mechanism driven by hydraulic pressure, and includes, for example, a telescopic jack J that presses-in the above-described reinforcement steel plate assembly 20, a pressing jig D1 made of a steel member that uniformly transmits the pressure of the telescopic jack to the reinforcement steel plate assembly 20.

(Swell Prevention Member Mounting Step)

Figure 8:
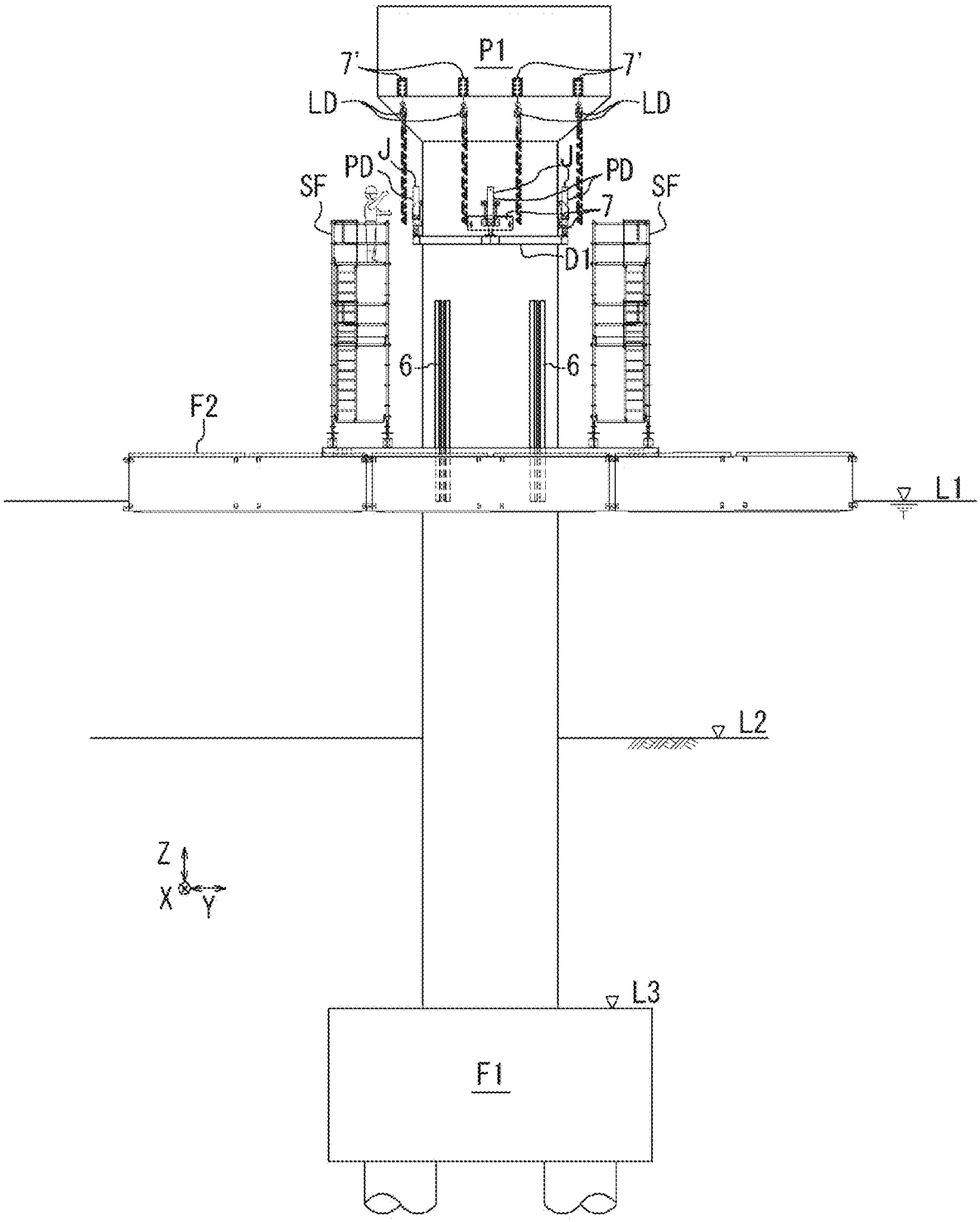
FIG. 8 is a diagram illustrating a swell prevention member mounting step of the steel plate press-in method.

Subsequently, as illustrated in FIGS. 4 and 8, in the steel plate press-in method according to the present embodiment, a swell prevention member mounting step is performed in which the above-described swell prevention member 6 is mounted. FIG. 8 is a diagram illustrating the swell prevention member mounting step of the steel plate press-in method according to the present embodiment.

Specifically, in this step, the plurality of latching plates 61 and 62 are mounted to an upper part of the outer peripheral surface of the bridge pier P1 above the water level L1 at the time of construction so as to be spaced apart in the horizontal direction (bridge axis perpendicular direction Y) and are fixed to the bridge pier P1 by chemical anchor of M16, and the slit 63 is formed between the latching plate 61 and the latching plate 62 (see FIG. 3). This step may be performed simultaneously with a reinforcement steel plate assembling step described later.

(Reinforcement Steel Plate Assembling Step)

Figure 9:
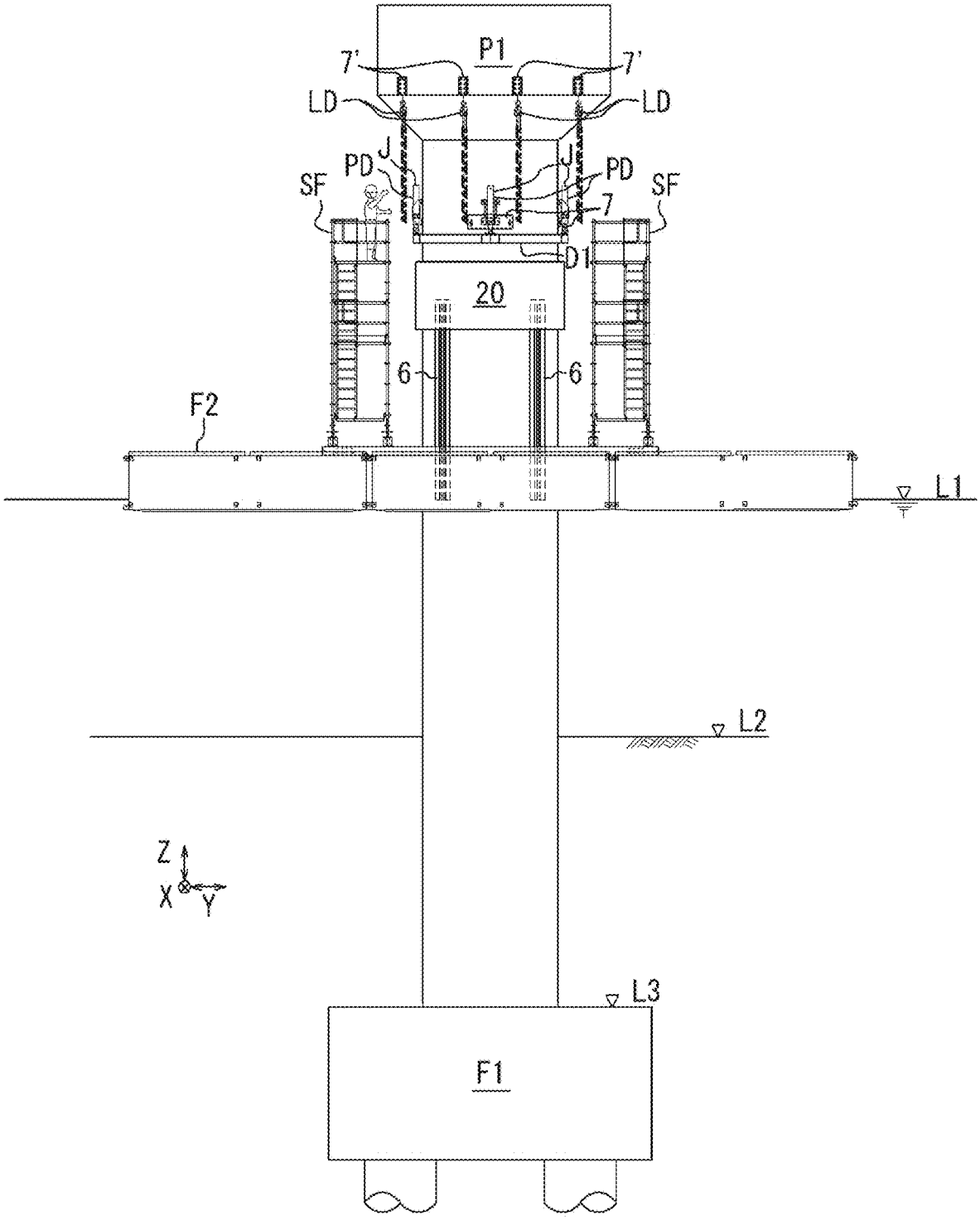
FIG. 9 is a diagram illustrating a reinforcement steel plate assembling step of the steel plate press-in method.

Subsequently, as illustrated in FIGS. 4 and 9, in the steel plate press-in method according to the present embodiment, a reinforcement steel plate assembling step is performed to assemble a single unit of the reinforcement steel plate assembly 20. FIG. 9 is a diagram illustrating the reinforcement steel plate assembling step of the steel plate press-in method according to the present embodiment.

Specifically, in this step, the left and right end surfaces of the reinforcement steel plate are welded and joined by complete penetration welding to assemble a single unit of the reinforcement steel plate assembly 20 having an oval shape that is spaced apart from the outer peripheral surface of the bridge pier P1 by a certain distance. In the present embodiment, since the cross section of the bridge pier P1 is an oval, the reinforcement steel plate is assembled to have a frame form conforming to the outer periphery of an oval-shaped cross section similar to that of the bridge pier P1. Of course, when the cross section of the bridge pier P1 is circular, elliptical, or rectangular, the reinforcement steel plate is assembled to have a cross section similar to that of the bridge pier P1. When the reinforcement steel plate assembly 20 is assembled, as described above, the stiffener 21 having a T-shaped cross section protruding from the inner surface of the reinforcement steel plate assembly 20 is inserted into the slit 63 of the swell prevention member 6 (see FIG. 3A).

The joining method of the end surfaces of the press-in reinforcement steel plate 2 is not limited to weld joining, and other joining methods such as mechanical joining using rivets, bolts, or the like and friction stir welding (FSW) may be used.

(Reinforcement Steel Plate Assembling and Lowering) Step

Figure 10:
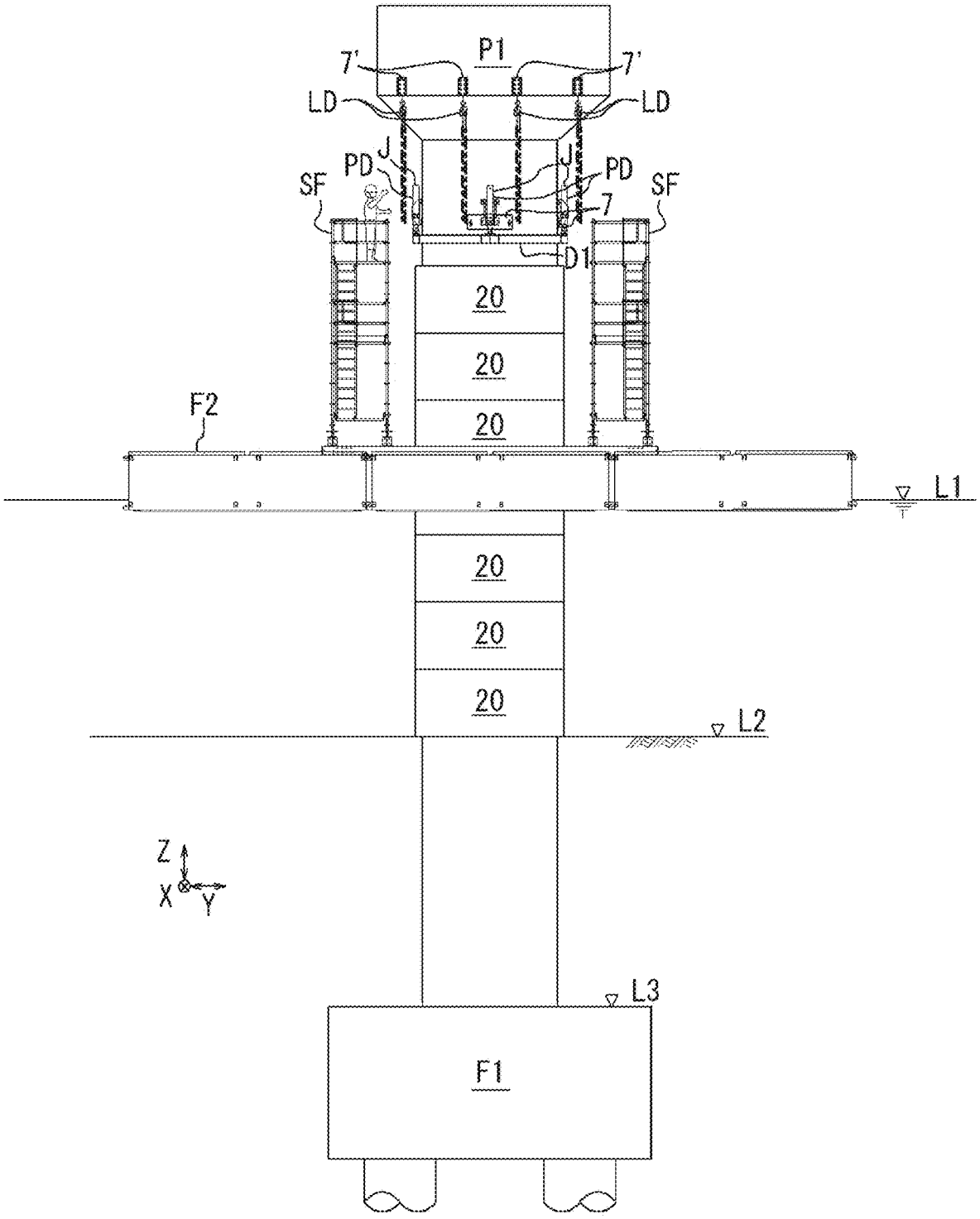
FIG. 10 is a diagram illustrating a reinforcement steel plate assembling and lowering step of the steel plate press-in method.

Subsequently, as illustrated in FIGS. 4 and 10, in the steel plate press-in method according to the present embodiment, a reinforcement steel plate assembling and lowering step is performed in which reinforcement steel plate assemblies 20 are vertically joined by welding or the like and lowered, and assembling and lowering are repeated until the reinforcement steel plate assemblies 20 that are sequentially and vertically connected reach the riverbed L2, which is the ground. FIG. 10 is a diagram illustrating the reinforcement steel plate assembling and lowering step of the steel plate press-in method according to the present embodiment.

Specifically, in this step, the reinforcement steel plate assemblies 20 assembled in the previous reinforcement steel plate assembling step are vertically joined by welding or the like and lowered using, for example, the manual lifting device LD, and assembling and lowering are sequentially repeated until the reinforcement steel plate assemblies 20 that are sequentially and vertically connected reach the riverbed L2, which is the ground.

(Press-In Step)

Figure 11:
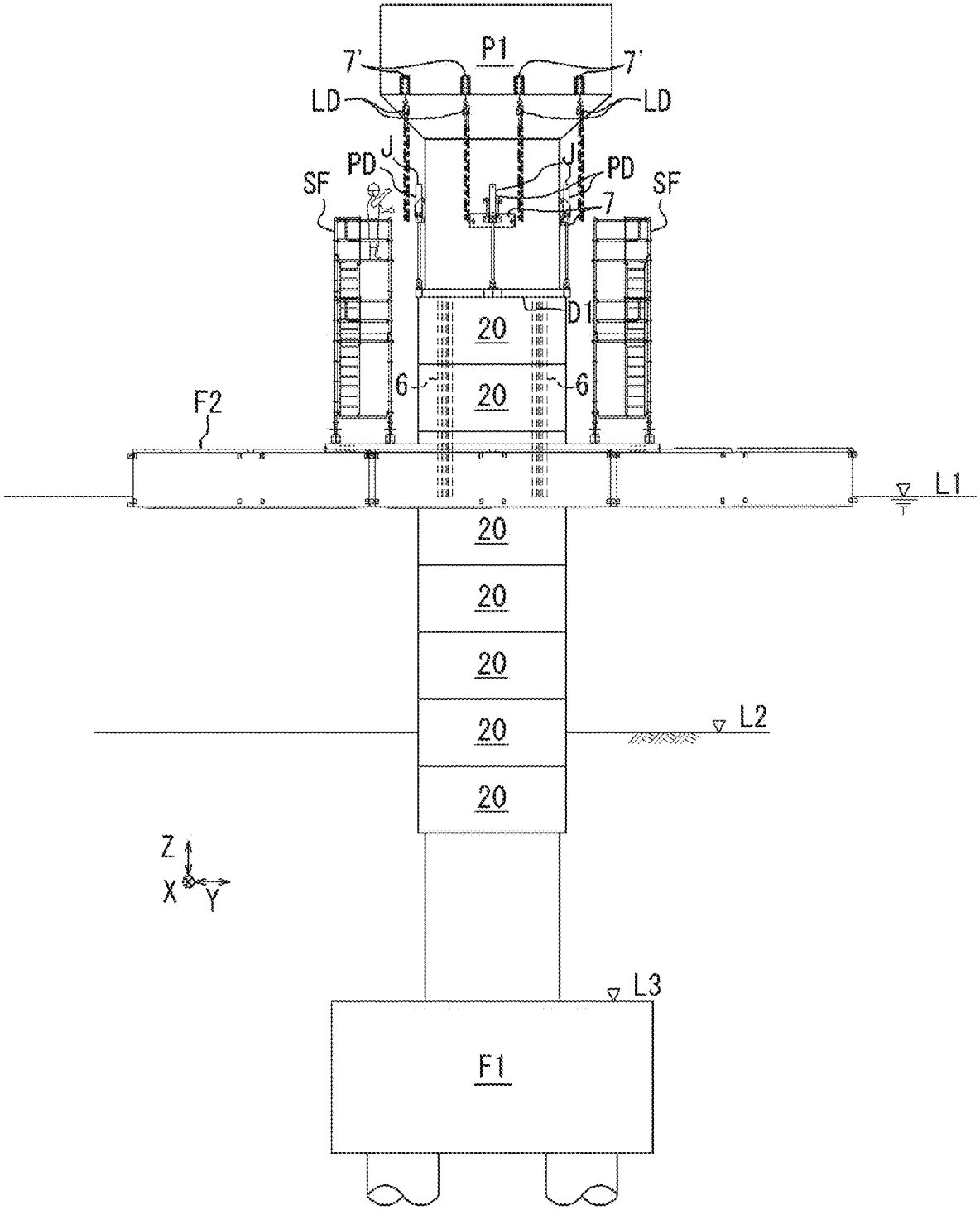
FIG. 11 is a diagram illustrating a press-in step of the steel plate press-in method.

Subsequently, as illustrated in FIGS. 4 and 11, in the steel plate press-in method according to the present embodiment, a press-in step is performed in which the reinforcement steel plate assemblies 20 assembled in the reinforcement steel plate assembling and lowering step and reaching the riverbed L2 are pressed-in to the ground around the bridge pier P1 using the press-in device PD mounted to the upper part of the bridge pier P1 in the press-in device installing step. At this time, the earth and sand entering the gap G (see FIG. 2A) between the reinforcement steel plate assembly 20 and the bridge pier P1 are discharged by injecting high-pressure water using a water jet or the like. FIG. 11 is a diagram illustrating the press-in step of the steel plate press-in method according to the present embodiment.

In this step, the reinforcement steel plate assemblies 20 are pressed-in using the swell prevention members 6 as the guide member for guiding the assemblies in the vertical direction since, as described above, the swell prevention members 6 have been mounted to the outer peripheral surface of the bridge pier P1 in the swell prevention member mounting step and the stiffeners 21 have been inserted in the slit 63 of the swell prevention members 6 in the reinforcement steel plate assembling step. This configuration enables the reinforcement steel plate assemblies 20 (press-in reinforcement steel plates 2) to be precisely pressed-in in the vertical direction.

(Repetition of Reinforcement Steel Plate Assembly and) Press-In)

Figure 12:
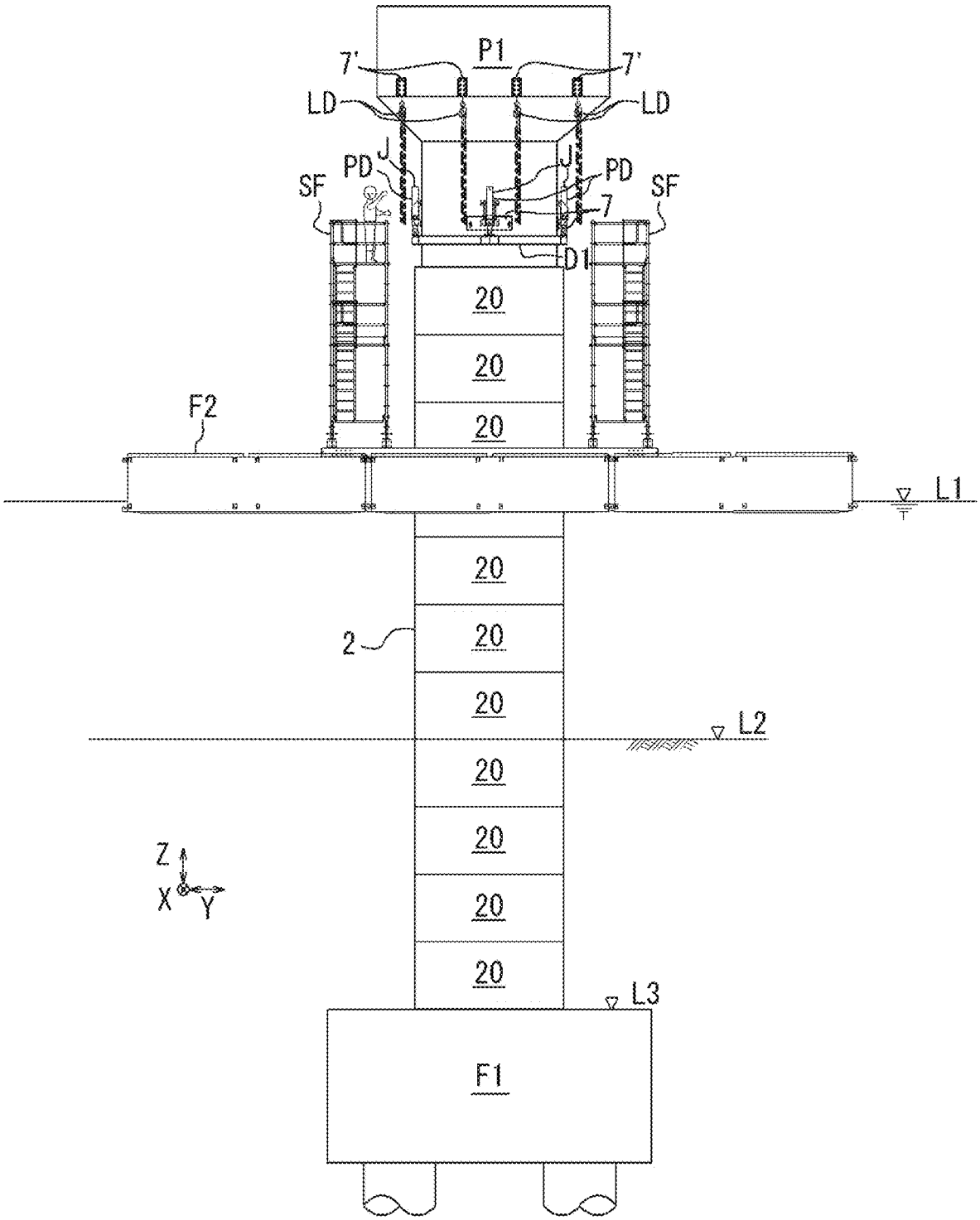
FIG. 12 is a diagram illustrating a state in which the press-in step of the steel plate press-in method is completed.

Subsequently, as illustrated in FIGS. 4 and 12, in the steel plate press-in method according to the present embodiment, the reinforcement steel plate assembling step and the press-in step described above are repeated a plurality of times and the reinforcement steel plate assemblies 20 are pressed-in until the lower end of them reaches a predetermined depth according to the structural design. FIG. 12 is a diagram illustrating a state in which the press-in step of the steel plate press-in method according to the present embodiment is completed.

(Press-In Device Removing Step)

Figure 13:
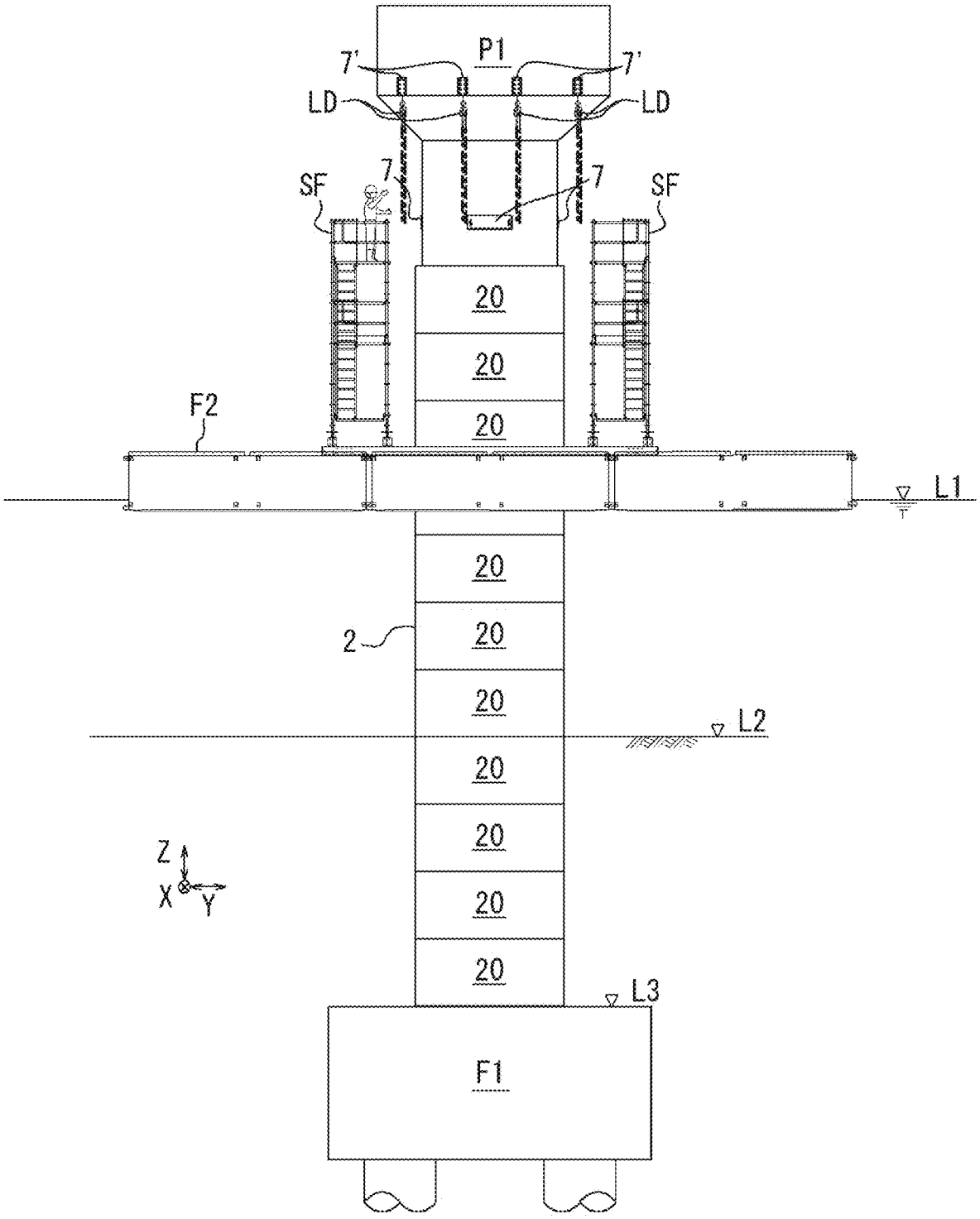
FIG. 13 is a diagram illustrating a press-in device removing step of the steel plate press-in method.

Subsequently, as illustrated in FIGS. 4 and 13, in the steel plate press-in method according to the present embodiment, a press-in device removing step is performed in which the press-in device PD installed in the press-in device installing step is removed. FIG. 13 is a diagram illustrating the press-in device removing step of the steel plate press-in method according to the present embodiment.

(Support Installing Step)

Subsequently, as illustrated in FIGS. 4 and 14 to 20, in the steel plate press-in method according to the present embodiment, a support installing step is performed in which the support 5 that prevents swell of the reinforcement steel plate assembly 20 (press-in reinforcement steel plate 2) in a filler filling step to be described later is installed around the reinforcement steel plate assembly 20 (press-in reinforcement steel plate 2).

Specifically, in this step, as illustrated in FIG. 1, three supports 5 that are first to third supports 5 from the bottom are installed around the underwater portion of the press-in reinforcement steel plate 2 between the water level L1 at the time of construction and the riverbed L2 at substantially equal intervals.

Figure 14:
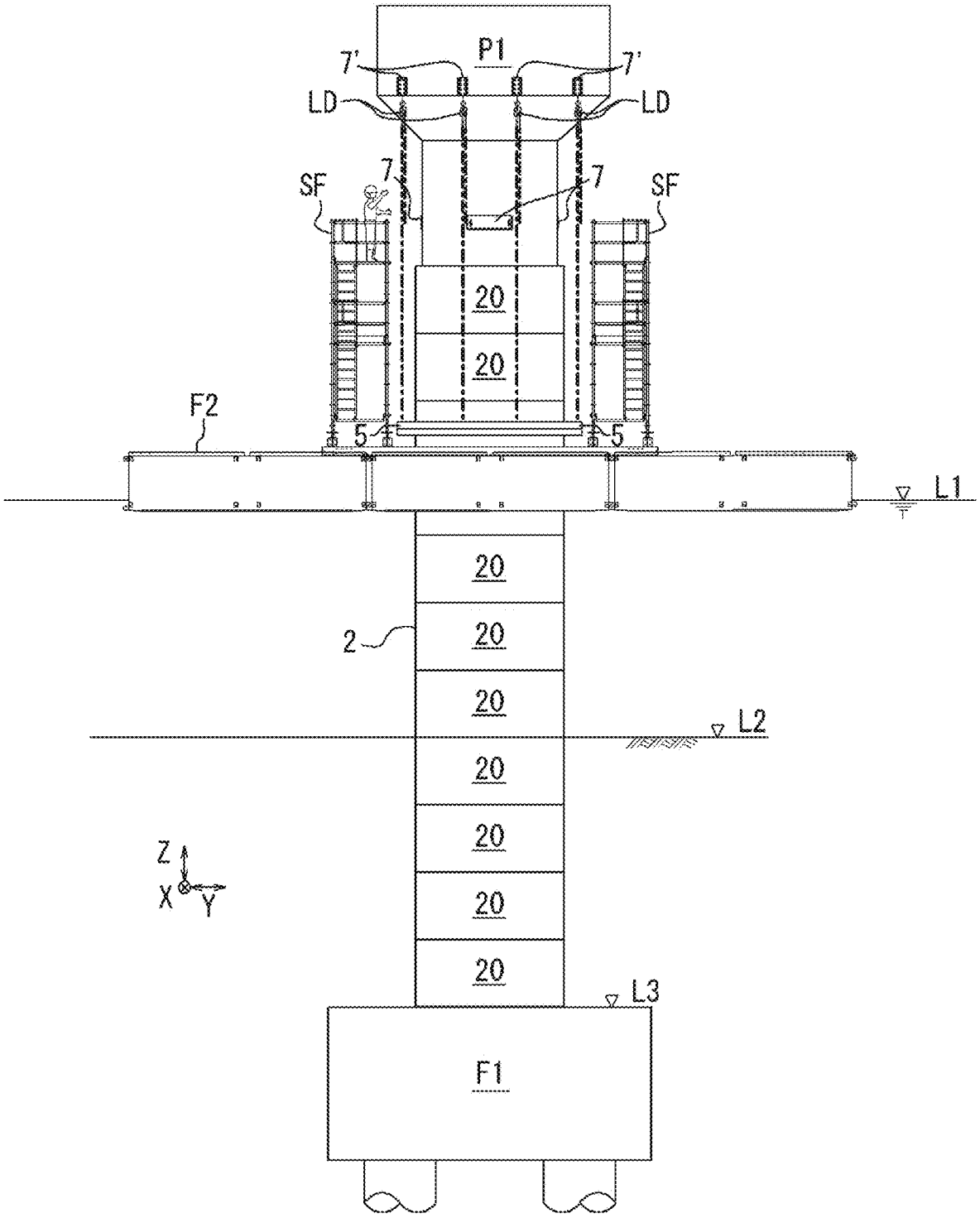
FIG. 14 is a diagram illustrating a first support assembling step in a support installing step of the steel plate press-in method.

First, in this step, as illustrated in FIG. 14, a first support assembling step is performed (see also FIG. 2A) in which the first support 5 from the bottom is assembled on the float F2 from the long side portions 5*a*, the short side portions 5*b*, the corner pieces 5*c*, and the like with the manual lifting device LD such as a chain block lifting and supporting these portions. FIG. 14 is a diagram illustrating the first support assembling step in the support installing step of the steel plate press-in method according to the present embodiment.

Figure 15:
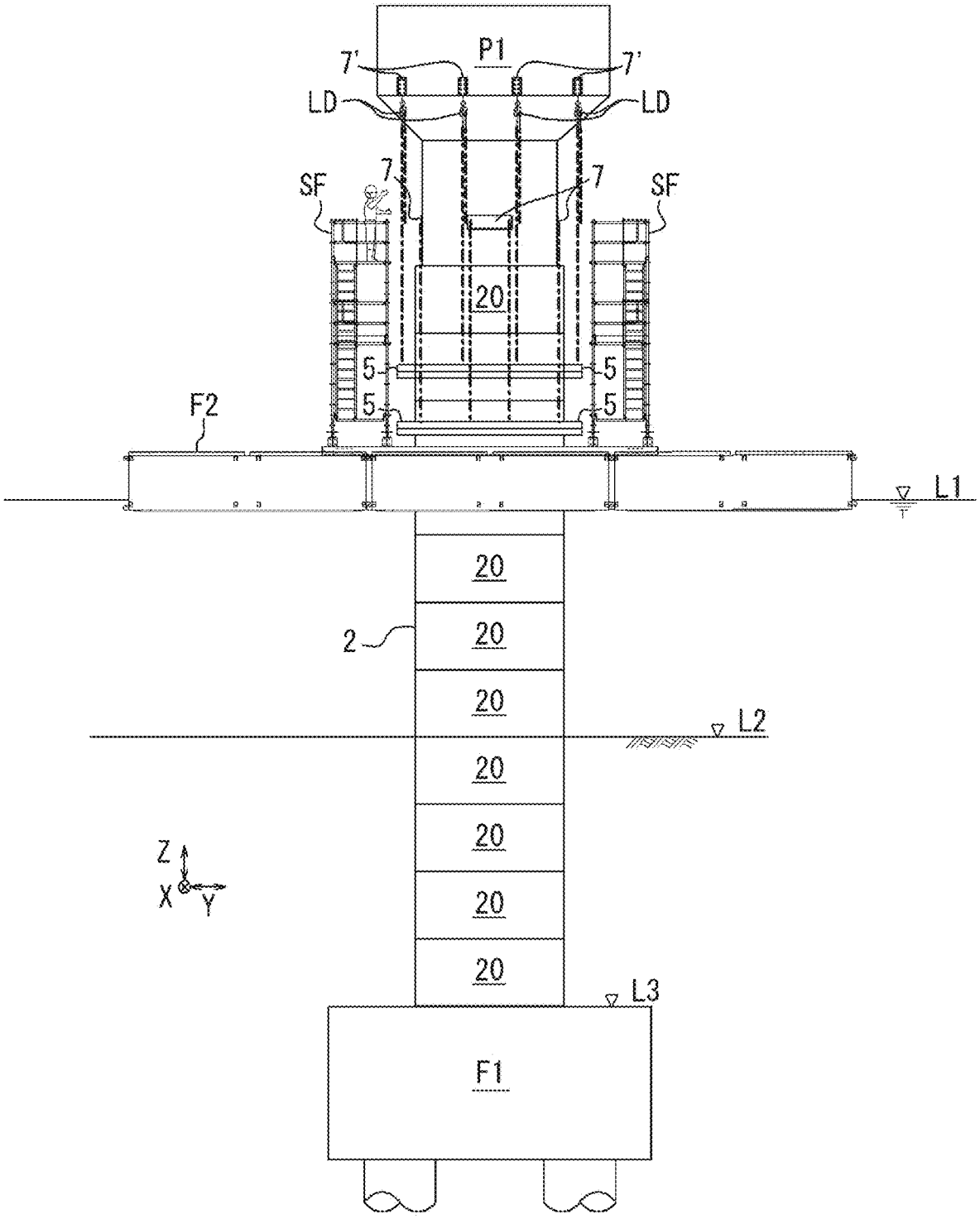
FIG. 15 is a diagram illustrating a second support assembling step in the support installing step of the steel plate press-in method.

Subsequently, in this step, as illustrated in FIG. 15, after the hanging point supporting the first support 5 is transferred from the manual lifting device LD to the reaction force resistant steel plate 7 using a wire rope or the like, a second support assembling step is performed in which H-shaped steel beams as the retainer are lifted and supported using the vacant manual lifting device LD and the second support 5 from the bottom is assembled on the float F2. FIG. 15 is a diagram illustrating the second support assembling step in the support installing step of the steel plate press-in method according to the present embodiment.

Figure 16:
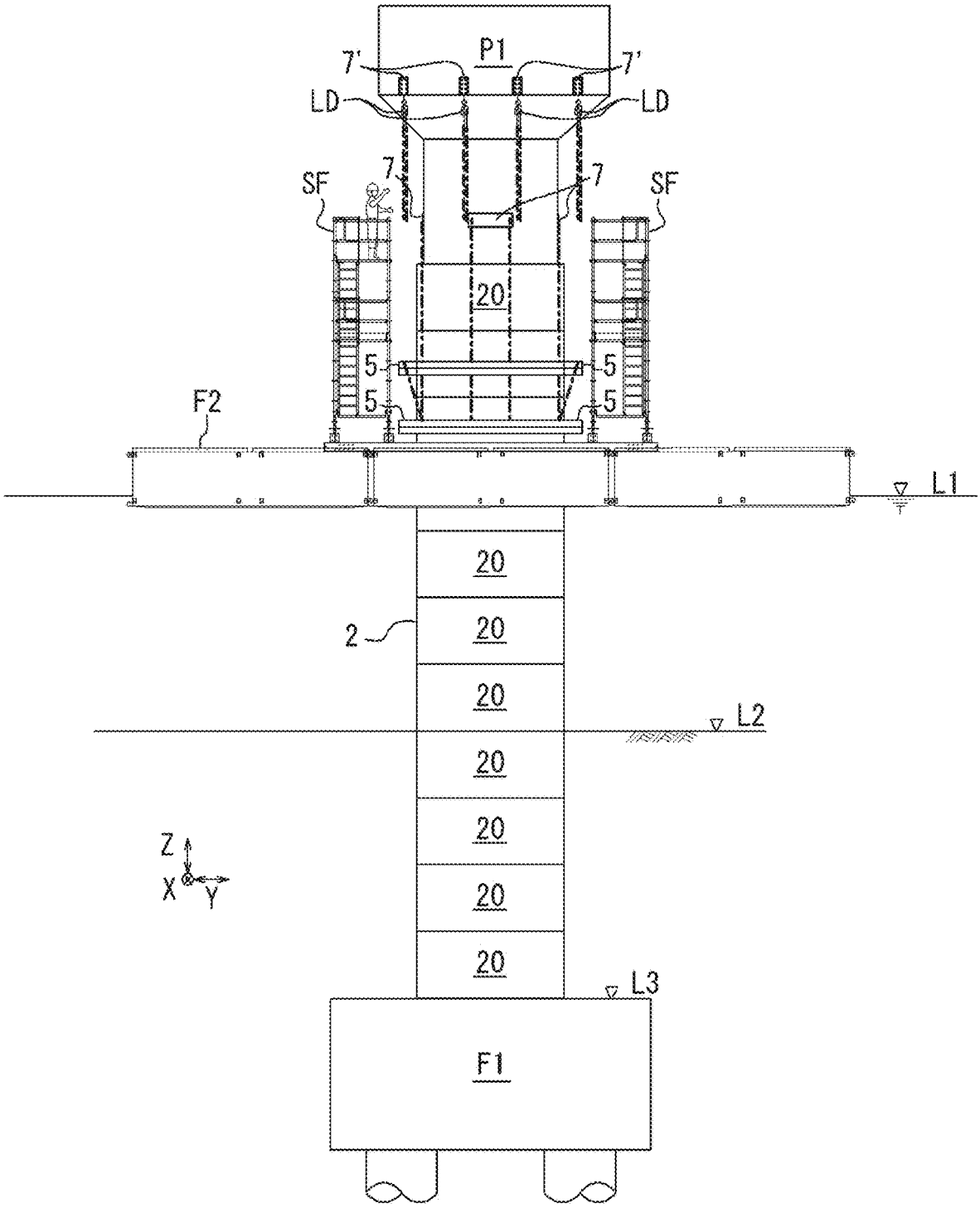
FIG. 16 is a diagram illustrating a first and second supports hanging point transfer step in the support installing step of the steel plate press-in method.

Further, in this step, as illustrated in FIG. 16, after the second support 5 is assembled, a first and second supports hanging point transfer step is performed in which the hanging point hanging and supporting the second support 5 is transferred from the manual lifting device LD to the reaction force resistant steel plate 7, and the hanging point of the first support 5 is transferred from the reaction force resistant steel plate 7 to the assembled second support 5 by, for example, tying a wire rope with a wire or the like to the second support 5. FIG. 16 is a diagram illustrating the first and second supports hanging point transfer step in the support installing step of the steel plate press-in method according to the present embodiment.

Figure 17:
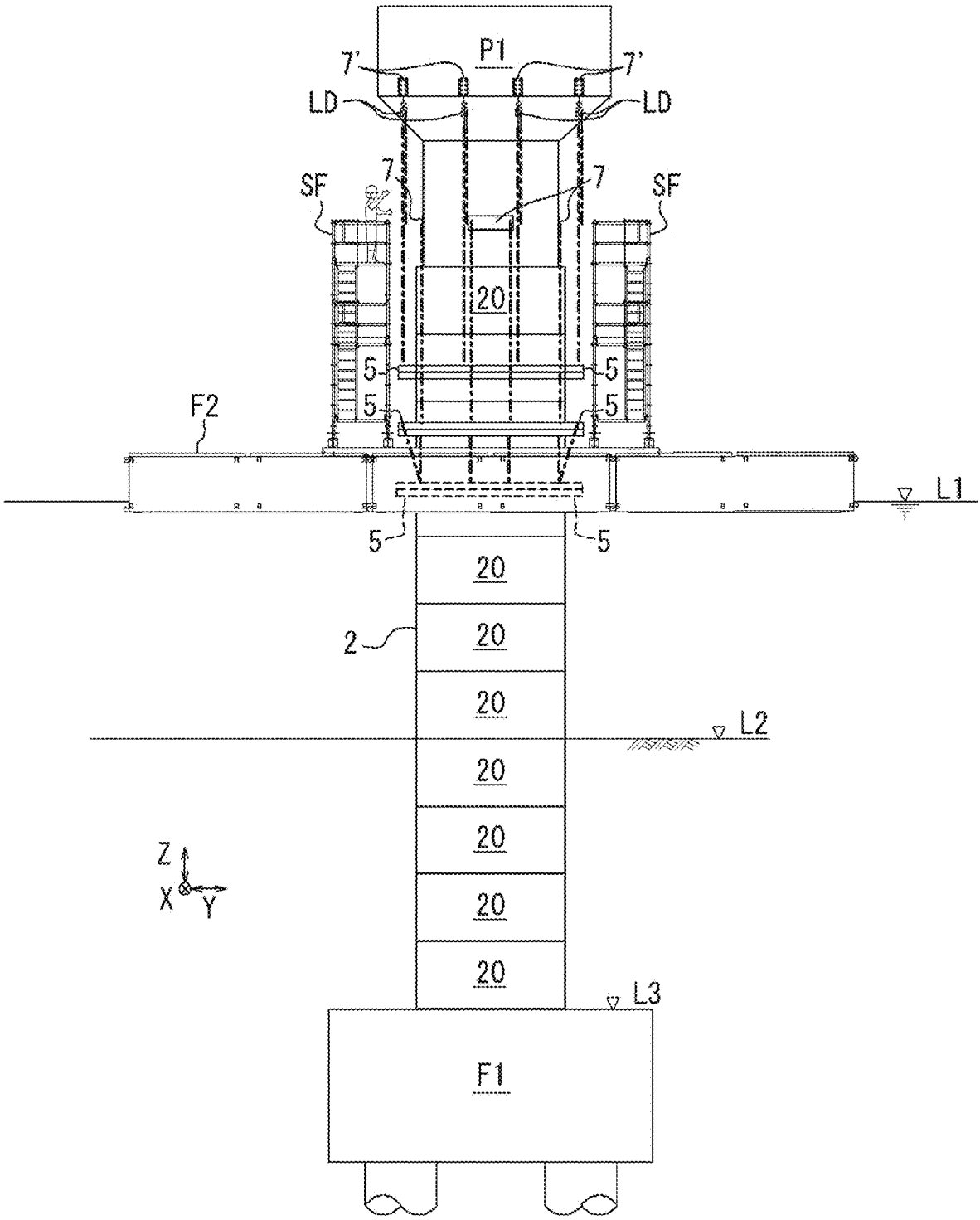
FIG. 17 is a diagram illustrating a third support assembling step in the support installing step of the steel plate press-in method.

Subsequently, in this step, as illustrated in FIG. 17, a third support assembling step is performed (see also FIG. 2A) in which the third support 5 from the bottom is assembled on the float F2 with the vacant manual lifting device LD hanging and supporting H-shaped steel beams. FIG. 17 is a diagram illustrating the third support assembling step in the support installing step of the steel plate press-in method according to the present embodiment.

Figure 18:
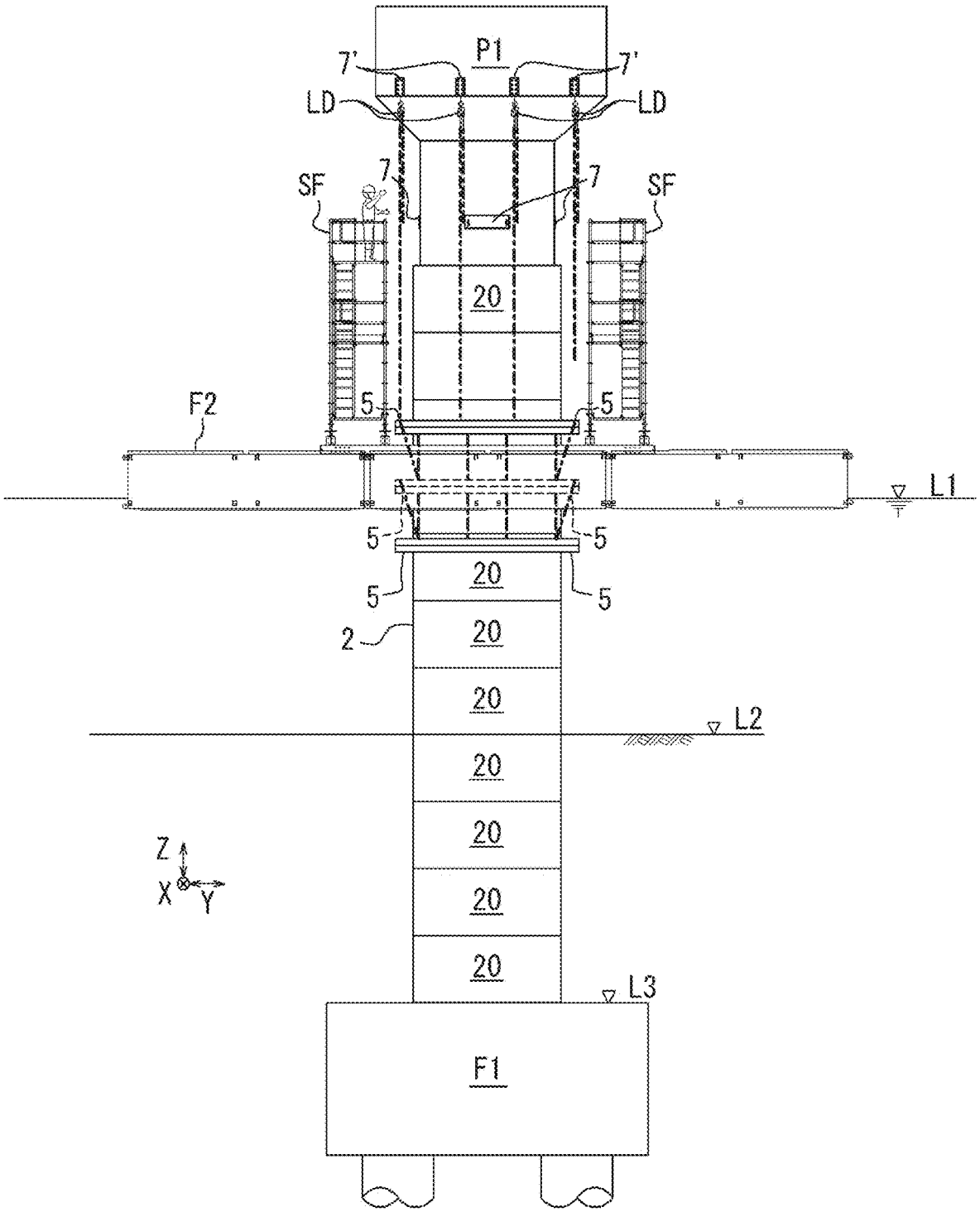
FIG. 18 is a diagram illustrating a second support hanging point transfer step in the support installing step of the steel plate press-in method.

Subsequently, in this step, as illustrated in FIG. 18, after the third support 5 is assembled, a second support hanging point transfer step is performed in which the hanging point of the second support 5 is transferred from the reaction force resistant steel plate 7 to the assembled third support 5. FIG. 18 is a diagram illustrating the second support hanging point transfer step in the support installing step of the steel plate press-in method according to the present embodiment.

Figure 19:
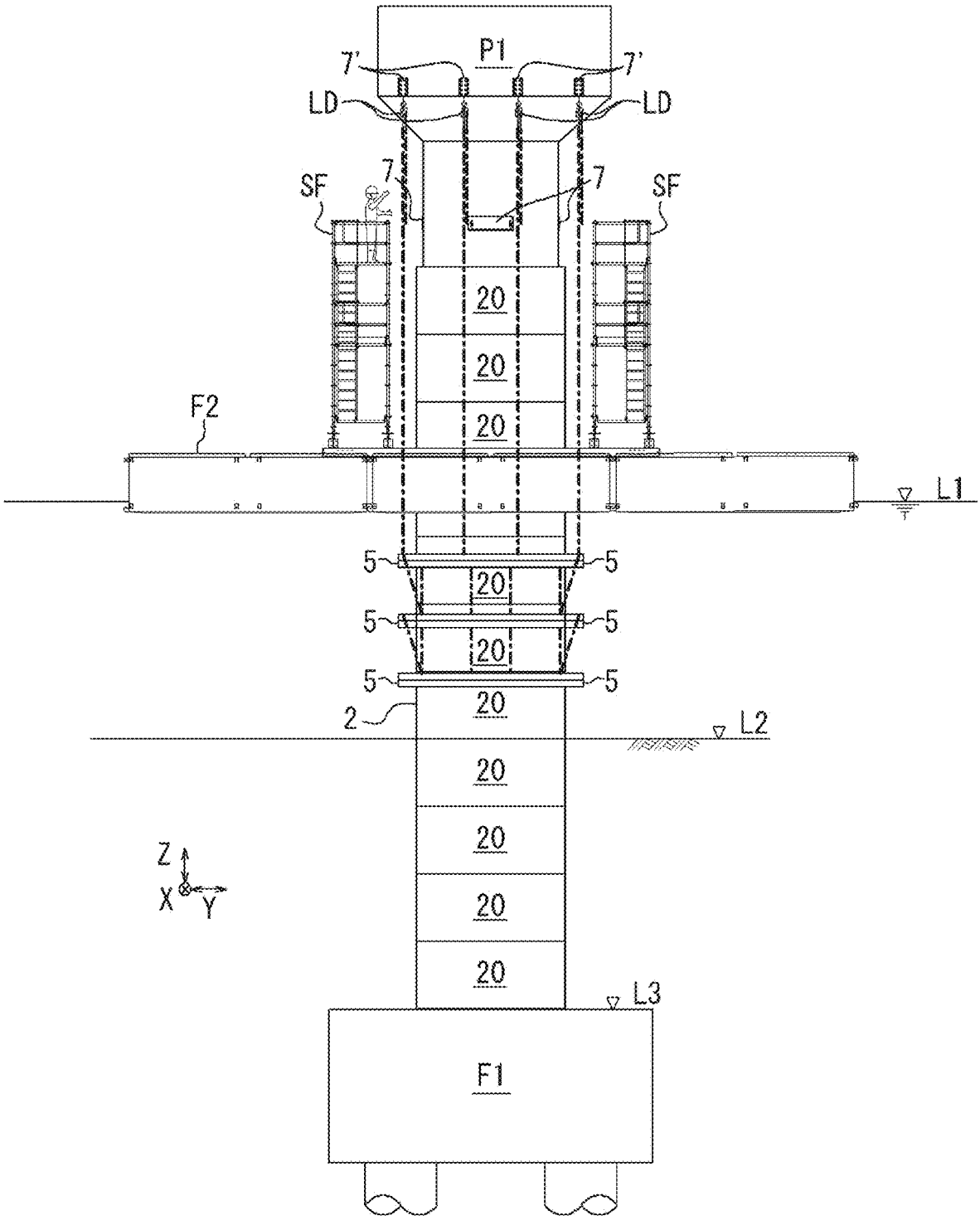
FIG. 19 is a diagram illustrating a support lowering and installing step in the support installing step of the steel plate press-in method.

Finally, in this step, as illustrated in FIG. 19, a support lowering and installing step is performed in which the first to third supports 5 are collectively lowered to a predetermined position using the manual lifting device LD, and a backing member such as uniblock (registered trademark) or a wedge made of steel member or the like is inserted in the gap G between the outer peripheral surface of the reinforcement steel plate assembly 20 (press-in reinforcement steel plate 2) and the support 5 to fix the support 5. FIG. 19 is a diagram illustrating the support lowering and installing step in the support installing step of the steel plate press-in method according to the present embodiment.

(Cleaning Step)

Subsequently, as illustrated in FIG. 4, in the steel plate press-in method according to the present embodiment, a cleaning step is performed in which the gap G, which is a clearance at the time of press-in, is cleaned.

Specifically, in this step, earth, sand, and suspended matters adhering to the inner peripheral surface of the reinforcement steel plate assembly 20, the surface of the bridge pier P1, and in the gap G are washed by injecting high-pressure water using water jet or the like.

(Filler Filling Step)

Subsequently, as illustrated in FIG. 4, in the steel plate press-in method according to the present embodiment, a filler filling step is performed in which the gap G between the reinforcement steel plate assembly 20 and the bridge pier P1 is filled with the filler 3 (see FIGS. 2A and 2B).

In this step, the gap G cleaned in the previous cleaning step is filled with the filler 3 made of a cementitious time hardening material such as mortar or concrete. The filler 3 for filling is not limited to a cementitious time hardening material, and may be a mixture of, for example, a filler and a resin adhesive such as an epoxy resin.

(Support Disassembling and Removing Step)

Subsequently, as illustrated in FIG. 4, in the steel plate press-in method according to the present embodiment, a support disassembling and removing step is performed in which the first to third supports installed in the support installing step are disassembled and removed. In this step, the first to third supports 5 are collectively lifted above the float F2 by using the manual lifting device LD in the reverse step of the support lowering and installing step illustrated in FIG. 19, and the hanging points of the supports 5 are transferred and the supports 5 are sequentially disassembled and removed from the lowermost first support 5.

After all the supports 5 are disassembled and removed, the reaction force resistant steel plates 7, which are no longer used, are also removed.

(Post-Installation Reinforcement Steel Plate Installing Step)

Figure 20:
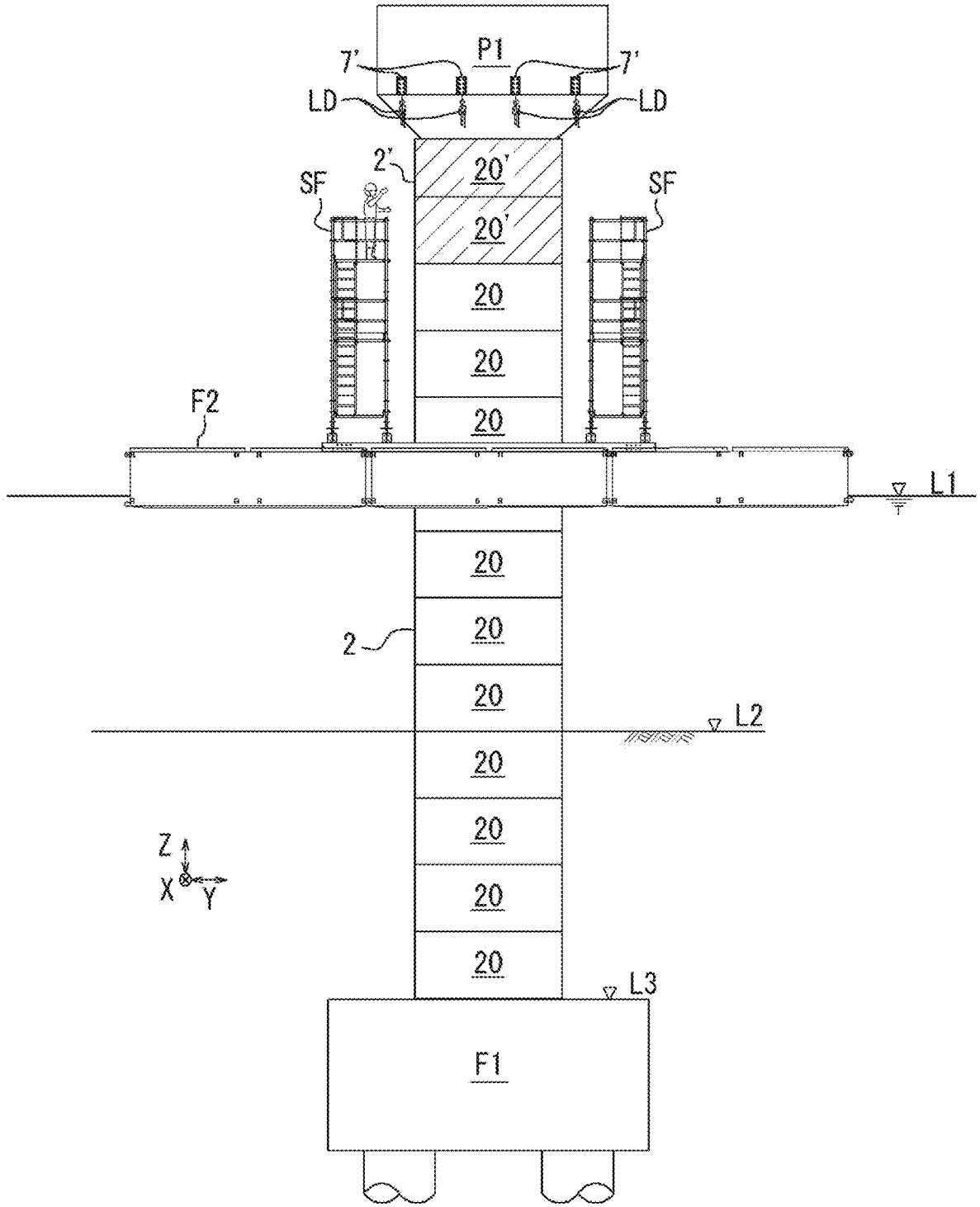
FIG. 20 is a diagram illustrating a post-installation reinforcement steel plate installing step of the steel plate press-in method.

Subsequently, as illustrated in FIGS. 4 and 20, in the steel plate press-in method according to the present embodiment, a post-installation reinforcement steel plate assembling and installing step is performed in which a reinforcement steel plate assembly 20' of a post-installation reinforcement steel plate 2', which is the post-installation part indicated by diagonal lines as described above, is assembled on the scaffold and installed. This step is performed in the same manner as the conventional steel plate jacketing method. FIG. 20 is a diagram illustrating the post-installation reinforcement steel plate installing step of the steel plate press-in method according to the present embodiment.

(Post-Installation Part Filler Filling Step)

Subsequently, as illustrated in FIG. 4, in the steel plate press-in method according to the present embodiment, a post-installation part filler filling step is performed in which the gap G (see FIG. 2A) between the reinforcement steel plate assembly 20' of the post-installation reinforcement steel plate 2' and the bridge pier P1 is filled with the filler 3, the post-installation reinforcement steel plate 2' being installed in the previous post-installation reinforcement steel plate installing step.

After the post-installation part filler filling step is completed, the filler 3 is hardened and the reinforcement steel plate assemblies 20' and 20 and the bridge pier P1 are integrated, and then the steel plate press-in method according to the present embodiment is ended. Of course, anticorrosion coating may be applied to the press-in reinforcement steel plate 2 and the post-installation reinforcement steel plate 2' as necessary.

According to the swell prevention structure 1 and the steel plate press-in method according to the present embodiment described above, since the swell prevention member 6 is installed above the water level at the time of construction, the swell prevention member 6 can be precisely mounted even when the height of the existing columnar structure (bridge pier P1) to be reinforced is large and the lower portion of the existing columnar structure is located in water. In this regard, according to the swell prevention structure 1 and the steel plate press-in method, the swell prevention member 6 can also function as the guide member that guides the press-in reinforcement steel plate 2 in the vertical direction at the time of press-in, so that the press-in reinforcement steel plate 2 can be accurately pressed-in and can be prevented from swelling or deviating due to the internal pressure of the filler 3.

Moreover, according to the swell prevention structure 1 and the steel plate press-in method, in addition to the swell prevention member 6, the support 5 is installed around the underwater portion of the press-in reinforcement steel plate 2. This configuration can reliably prevent the press-in reinforcement steel plate 2 from swelling or deviating due to the internal pressure of the filler 3.

The press-in reinforcement steel plate underwater swell prevention structure 1 according to the embodiment of the present invention and the steel plate press-in method using the same have been described in detail. However, any of the above-described or illustrated embodiments is merely an embodiment embodied in carrying out the present invention. Therefore, the technical scope of the present invention should not be interpreted in a limited manner by those embodiments.

What is claimed is:

1. A press-in reinforcement steel plate underwater swell prevention structure that prevents, in filling with a filler, swell of a press-in reinforcement steel plate pressed-in for reinforcement around an existing columnar structure part of which is built in water, the press-in reinforcement steel plate underwater swell prevention structure comprising:

a pair of swell prevention members having a Z-shaped cross section and mounted to an upper part of the existing columnar structure above a water level at time of construction, a slit being formed between the swell prevention members;

a plurality of stiffeners having a T-shaped cross section and mounted to an inner surface of the press-in reinforcement steel plate, at least one of the plurality of stiffeners being inserted in the slit; and one or a plurality of supports made of assembled steel members and installed around an underwater portion of the press-in reinforcement steel plate to prevent swell of the press-in reinforcement steel plate in filling with a filler.

2. A steel plate press-in method for pressing-in a press-in reinforcement steel plate around an existing columnar structure built in water for reinforcement, the steel plate press-in method comprising:

a swell prevention member mounting step of mounting a pair of swell prevention members having a Z-shaped cross section to an upper part of the existing columnar structure above a water level at time of construction and forming a slit between the swell prevention members;

a press-in step of pressing-in the press-in reinforcement steel plate around the existing columnar structure; and a filler filling step of filling a gap between the press-in reinforcement steel plate and the existing columnar structure with a filler, wherein the press-in step includes inserting a stiffener protruding from an inner surface of the press-in reinforcement steel plate into the slit between the swell prevention members mounted in the swell prevention member mounting step and pressing-in the press-in reinforcement steel plate while being guided by the swell prevention members in a press-in direction, the steel plate press-in method further comprising, before the filler filling step, a support installing step of installing, around an underwater portion of the press-in reinforcement steel plate, a support that prevents swell of the press-in reinforcement steel plate in the filler filling step.

* * * * *